US005163261A

United States Patent [19]

O'Neill

[11] Patent Number: 5,163,261

[45] Date of Patent: Nov. 17, 1992

[54] RETAINING WALL AND SOIL REINFORCEMENT SUBSYSTEMS AND CONSTRUCTION ELEMENTS FOR USE THEREIN

[76] Inventor: Raymond J. O'Neill, 3 Garmany Pl., Yonkers, N.Y. 10710

[21] Appl. No.: 496,787

[22] Filed: Mar. 21, 1990

[51] Int. Cl.[5] ..... E02D 29/02

[52] U.S. Cl. ..... 52/610; 52/594; 52/602; 405/284; 405/286

[58] Field of Search ..... 52/169.1, 169.9, 602, 52/586, 594, 595, 610; 405/284–287, 262

[56] References Cited

U.S. PATENT DOCUMENTS

| | | | |
|---|---|---|---|
| 3,877,236 | 4/1975 | O'Neill et al. . | |
| 4,372,091 | 2/1983 | Brown et al. . | |
| 4,380,409 | 4/1983 | O'Neill . | |
| 4,470,728 | 9/1984 | Broadbent | 405/286 |
| 4,592,678 | 6/1986 | McNinch, Jr. et al. . | |
| 4,661,023 | 4/1987 | Hilfiker | 405/286 X |
| 4,684,294 | 8/1987 | O'Neill . | |
| 4,728,227 | 3/1988 | Wilson et al. | 405/284 |
| 4,824,293 | 4/1989 | Brown et al. | 405/284 |
| 4,884,921 | 12/1989 | Smith . | |
| 4,968,186 | 11/1990 | Ogorchock | 405/262 |
| 4,990,032 | 2/1991 | Smith . | |

OTHER PUBLICATIONS

Interlocking Precast Retaining Wall System Field Manual, by Doublewal Corporation, dated 1987.

"Rigid Model Wall With Soil Reinforcement", by M. R. Hausmann, et al., published in Symposium on Earth Reinforcement, by American Society of Civil Engineers, Apr. 27, 1978, pp. 400–401.

"Designs of Fabric Reinforced Retaining Structures", by Bengt T. Broms, published in Symposium on Earth Reinforcement, by American Society of Civil Engineers, Apr. 27, 1978, pp. 282–283.

Specifications of Precast Concrete Retaining Wall, by Doublewal Corporation, dated Jun. 5, 1980.

"Tensar Geogrids Solve Road Construction Problems at Corps. Emergency Project", in Construction Products Application Bulletin of ARMCO, Inc. 1986.

"Concrete Geowall Package: Reinforced Soil Retaining Wall Systems", brochure by the Tensar Corporation, 1987.

"High-Strength Tensar Geogrids Provide Ideal Reinforcement for Gabion Walls", by Contech Construction Products, Inc., 1987.

"Tensar Geogrids Cut Construction Time and Cost for a Variety of Earth Reinforcement Applications", in Application Bulletin by Contech Construction Products, Inc., 1986.

Tensar Field File Brochure, by the Tensar Corporation, 1987.

*Primary Examiner*—Richard E. Chilcot, Jr.

*Attorney, Agent, or Firm*—Hopgood, Calimafde, Kalil, Blaustein & Judlowe

[57] ABSTRACT

A construction element is disclosed for retaining a soil mass. In general, the construction element comprises a face panel and a plurality of protruding arms. The face panel has a forward wall, a rearward wall, side walls and a top and bottom wall. Such protruding arm extends from the rearward wall of the face panel, and each have an upper wall, lower wall, a back wall and side walls. The upper and lower walls of these protruding arms are each provided with engaging means for facilitating stacking of at least a portion of the protruding arm of one construction element, on top of at least a portion of the protruding arm of another construction element, and for preventing relative sliding movement therebetween. These construction elements can be used to construct a retaining wall and soil reinforcement subsystem, which comprises one or more free-standing retaining wall construction elements and at least one grid structure positioned behind each such construction element. In such a subsystem, the grid structures interlock with the soil beyond said face panel and create a substantially self-supporting, stable reinforced soil mass free of failure planes, permitting retaining wall heights that far exceed the height of the individual construction elements. Also disclosed is apparatus for molding the retaining wall construction elements of the present invention.

30 Claims, 13 Drawing Sheets

RETAINING WALL AND SOIL REINFORCEMENT SUBSYSTEMS AND CONSTRUCTION ELEMENTS FOR USE THEREIN

BACKGROUND OF THE INVENTION

1. Field of the Invention

The present invention relates to a retaining wall and soil reinforcement subsystem, and to an improved construction element for use therein.

2. Brief Description of Related Art

Retaining walls are presently used in a wide variety of architectural and site development applications including, for example, office developments, commercial complexes, industrial sites, residential developments, waterfront and coastal structures, and highway cut and fill areas. In such applications, it is not uncommon for the height of retaining walls to exceed 20 feet or more. In nearly all applications, such retaining walls must provide stability against pressures exerted by back fill soil and heavy surcharge loads.

One popular retaining wall system is commercially available from the Tensar Corporation of Morrow, Ga. and is marketed under the trademark Geowall TM. The Geowall TM system uses one-piece concrete panels for wall facing elements that can extend up to twenty feet in height. In order to maintain the wall facing panels in a vertically upright position, horizontally disposed polymer grid structures are securely connected to each wall facing panel, with each grid structure securely retained between layers of soil mass behind the wall face. When the grid structures are installed in the wall fill, their grid geometry interlocks with the adjacent soil to create a self-supporting, stable reinforced soil mass, thereby keeping soil pressures against the wall facing panels to a minimum. While such a prior art retaining wall system provides reinforcement to the soil fill behind the wall facing panel to (i) create a stable soil mass which stands independently of the wall facing panel, and (ii) permits the use of a variety of different facing elements, it nevertheless, suffers from several significant shortcomings and drawbacks.

In particular, since the height of the structures must equal the height of the resulting retaining wall system, heavy duty equipment is necessarily required on site for transporting and positioning of the wall facing panels into position. Also, during construction and assembly of such retaining wall systems, the wall panels must be externally braced, usually with inclined structures, which can only be removed when the wall fill behind the panels reaches two-thirds of the wall height; only until the attainment of such height, is the soil interlocked with the grid system and the retaining wall system self-supporting. Moreover, the physical connection of the grid structures to the wall panels requires "threading" each grid structure to protruding grid tabs embedded in the wall panels at time of manufacture. This threading process is both time consuming and labor intensive. Further, slack must be completely removed from the grid structures by creating pretension in the grid structure, using rakes installed in place after fill soil has been placed over the pretensioned grid structure; only thereafter, can the rakes be removed. This process is repeated for each alternating layer of soil and grid structure connected to the wall panel, until back fill soil reaches the height of the retaining wall structure.

There are, of course, several types of known retaining wall systems which are generally self-supporting.

For example, U.S. Pat. No. 4,592,678 to McNinch, Jr., et al. discloses a modular block retaining wall constructed from an ordered array of individual construction blocks. Each block has a horizontal cross-section defines a double "T" shape, where the top of the double "T" defines vertical face member and the stem of each "T" defines a generally planar leg member. Notably, elongated tension/reinforcing rods passing through vertically extending holes formed in each leg member are required in order to (i) prevent each stacked block from moving relevant to one another, (ii) achieve vertical alignment of stacked blocks, and (iii) create resistance from overturning moments. While providing a modular construction, such prior art construction blocks and retaining walls, nevertheless suffer from several significant shortcomings and drawbacks.

In particular, such prior art construction blocks cannot be "back stepped" relative to one another to form stepped retaining walls of various configuration; rather, only vertically upright retaining walls can be constructed from such construction blocks. Elongated tension/reinforcing rods must pass through each leg member to tie together a vertical array of such blocks, to prevent them from relative sliding and counteract overturning moments. Furthermore, a retaining wall system constructed from a stacked array of such blocks also requires that a concrete footing be poured under the bottom course of blocks.

Bin-type construction elements are also known for use in designing and building gravity retaining walls. Several such construction elements can be found in U.S. Pat. Nos. 3,877,236 and 4,380,409 to applicant, and 4,372,091 to Brown, et al. While these prior art construction elements have many positive features, they nevertheless have inherent drawbacks.

In particular, such construction elements are characterized by excessive weight and depth requirements. For example, these structures generally require a base that has a width of at least 50% of the desired wall height. Thus, a structure having a wall height of 20 feet would require a concrete base having a depth of 10 feet. These specific characteristics raise at least two significant problems for contractors when installing these units. One problem is the high cost of shipping such large units. The second problem is the expense associated with heavy lifting equipment required to set and place specific sized units into their desired location. In typical applications, such construction elements can weigh in excess of 10,000 pounds.

Another prior art construction element is disclosed in U.S. Pat. No. 4,684,294 to applicant and comprises an upstanding face panel arranged with a relatively long embedment beam integrally extending from the face panel in a generally T-shaped arrangement. An assembly of these construction elements are used to form a retaining wall anchored in place by the soil mass to be retained. While capable of being stacked in various configurations, such as "stacked-bonded arrays", "brick bonded patterns" and "stepped patterns", this prior art construction element has inherent drawbacks as well. For example, when forming "stepped", "stacked-bonded" or "brick-bonded" wall configurations with such construction elements, transverse support beams are required for interengaging notches formed in the embedment beam of each such construction element, in order to form a "shear key" system which prevents sliding and other movement of the assembled construction elements. Such support beams complicate retaining wall construction, and the excessive depth of the embodiment beams required for stability add to shipping and manufacturing costs.

Thus, there is clearly a great need in the construction art to provide a retaining wall construction element which can be used to construct a wide variety of retaining wall and soil reinforcement subsystems, in a simpler and easier manner.

Accordingly, it is a primary object of the present invention to provide a construction element which can be stacked and interengaged together to form a retaining wall of a variety of configurations, without the requirement of support beams used to prevent sliding and other movement of the assembled construction elements.

It is another object of the present invention to provide a retaining wall and soil reinforcement subsystem constructed from such construction elements, and which can be used to accommodate a variety of construction specifications and requirements.

It is a further object of the present invention to provide a retaining wall and soil reinforcement system of either planar-faced or stepped-back design and which does not require any additional blocks or shear keys to keep it stable.

It is an additional object of the present invention to provide a retaining wall construction element for use in conjunction with a soil reinforcement subsystem of the present invention, and which does not require attachment to the face wall of the construction element.

Another object of the present invention is to provide such construction element which is relatively lighter than prior art construction elements and thus eliminates the need for heavy lifting equipment and the high shipping costs.

An even further object of the present invention is to provide a construction element which can be used in conjunction with tie back rods to further stabilize a tall retaining wall assembled from a number of the construction elements of the present invention.

A further object of the present invention is to provide apparatus of modular design for molding retaining wall construction elements of the present invention.

SUMMARY OF THE PRESENT INVENTION

According to one aspect of the present invention a construction element for retaining a soil mass is provided. In general, the construction element comprises a face panel and a plurality of protruding arms. The face panel has a forward wall, a rearward wall, side walls and a top and bottom wall. Such protruding arm extends from the rearward wall of the face panel, and each have an upper wall, lower wall, a back wall and side walls. The upper and lower walls of these protruding arms are each provided with engaging means for facilitating stacking of at least a portion of the protruding arm of one construction element, on top of at least a portion of the protruding arm of another construction element, and preventing relative sliding movement therebetween.

In general, the engaging means of each protruding arm comprises a first set of periodically alternating projections and indents provided to the upper wall, and a second set of periodically alternating projections and indents provided to the lower wall. The geometry of such first and second sets of elements, is such that a selected portion of the first set of periodically alternating projections and indents of one construction element, interengage with a selected portion of the second set of periodically alternating projections and indents of another construction element.

In the preferred embodiment, the first and second sets of periodically alternating projections and indents are each realized as matched saw-toothed notched patterns provided to the upper and lower walls, respectively, of each protruding arm, to allow the construction elements to be selectively stacked upon and interengaged with one another, as desired.

Unlike prior art construction elements of the type disclosed in U.S. Pat. No. 4,684,294, the construction element of the present invention does not employ a single stem unit which, for stability, depends totally on both the length of the embedment beam into the soil mass, and a key beam or a shear block. Rather, the construction element of the present invention only requires at least two protruding arms to function properly. Thus, the construction elements hereof, when assembled, do not produce a true bin-type gravity wall system; rather, they produce a "thin-faced" gravity retaining wall system that may utilize soil reinforcement to achieve a degree of structural stability commensurate with the soiling loading conditions of a particular application.

It has been discovered that a construction element in accordance with the present invention, can be used to provide a retaining wall that is light weight, totally interlocked, and stable. As the height of the wall increases, soil reinforcement subsystems can be employed, taking advantage of the design of the construction element hereof.

One of the many advantages of the construction element of the present invention, is that, when stacked together, they can be used to form open face-walls, closed-face walls, stepped walls, flood control walls, plantable face panel walls, sloping walls and soil reinforced walls.

Because of the unique structural characteristics of the construction element of the present invention, it can also be modified to suit many design specification required for any particular wall thickness or surface geometry.

As a result of the present invention, the engineer can now erect a variety of possible designs, thicknesses and facial configurations, using a single type of construction element.

Another aspect of the present invention is to provide a retaining wall and soil reinforcement subsystem or module. In general, the subsystem comprises one or more retaining wall construction elements, and at least one grid structure positioned behind each construction element. Each retaining wall construction element is capable of being stacked together to form a free-standing retaining wall structure, and has a solid construction and a face panel and protruding arms. Each face panel has a front wall, a rear wall, side walls and top and bottom walls, whereas each protruding arm is attached to the rearward wall and has an upper wall, a lower wall, a back wall, and side walls. The face panel and multiple protruding arms of each construction element form at least one open-sided cavity for receipt of soil mass behind the face panel. At least one grid structure is positioned behind the face panel and is capable of being installed between layers of soil mass within the open cavity and therebeyond, to interlock with the soil beyond said face panel and create a substantially self-supporting, stable reinforced soil mass behind the face panel of the retaining wall structure.

In the preferred embodiment, the retaining wall construction element of the present invention is employed in constructing the retaining wall and soil reinforcement subsystem hereof. Typically, for each construction element, a plurality of grid structures are arranged behind the face panel with alternating layers of soil mass installed therebetween.

For example, where the retaining wall has a height exceeding the height of individual retaining wall construction elements, soil reinforcement is effectuated preferably behind each retaining wall construction element. This involves alternatingly (i) placing a layer of fill soil of sufficient height behind each free-standing retaining wall construction element, and (ii) disposing a grid or matrix structure over the layer of soil, until the soil height is approximately equal to the retaining wall height, thereby creating a self-supporting stable soil mass behind the wall and minimizing the soil pressures exerted thereagainst.

One significant advantage of the retaining wall and soil reinforcement subsystem of the present invention is that the grid structures need not at all be connected to the face panel or other structural elements of the self-supporting construction elements. Moreover, it is not necessary to pretension the grid structures prior to placing soil mass thereover. Also, with the subsystem of the present invention, there is no need to support the face panels of the construction elements using inclined struts, prior to installation of the grid structures within the soil mass to the wall fill. Consequently, erection of the retaining wall and soil reinforcement subsystem hereof is greatly simplified over that of prior art wall systems, permitting a substantial reduction in manufacturing costs, installation time, equipment and labor.

Another aspect of the present invention is to provide apparatus for molding retaining wall construction elements of the present invention, which have a solid prismatic face panel and solid prismatic multiple protruding arms. In general, the apparatus comprises a face panel mold portion, and a protruding arm mold portion for each protruding arm. The apparatus also includes support means for supporting each protruding arm mold portion substantially vertically upright while the face panel mold portion is cooperatively positioned with respect to the vertically upright protruding arm mold portions. In such a configuration, when concrete or like molding material is poured into the protruding arm mold portions, the concrete fills up the face panel mold portion to a predetermined level. Thereafter, the protruding arm mold portions are allowed to fill up with concrete. Such molding apparatus being modular in nature permits one or more of these basic components to be interchanged and used with mold components adapted for molding differently dimensioned construction elements.

BRIEF DESCRIPTION OF THE DRAWINGS

For a further understanding of the objects of the present invention, reference is made to the following detailed description of the preferred embodiment which is to be taken in connection with the accompanying drawings, wherein.

DETAILED DESCRIPTION OF PREFERRED EMBODIMENTS OF THE INVENTION

Figure 1B:
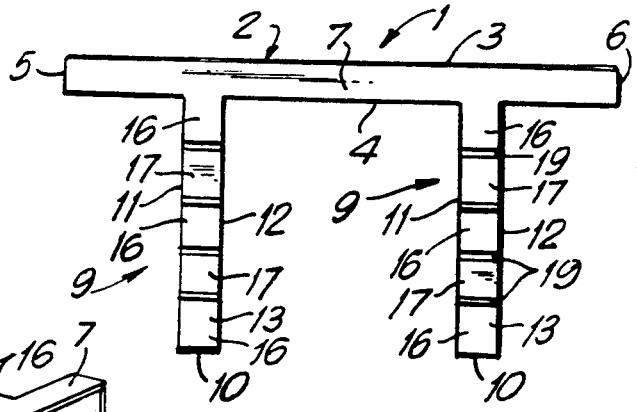
FIG. 1B is a plan view of the construction element shown in FIG. 1A.
Figure 1A:
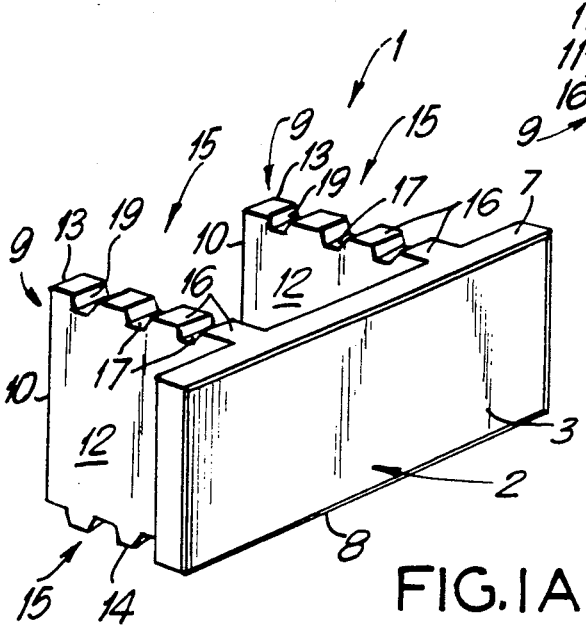
FIG. 1A is a perspective view of one embodiment of the retaining wall construction element of the present invention, showing integrally formed engaging means on the upper and lower wall panels of the protruding arms.
Figure 2:
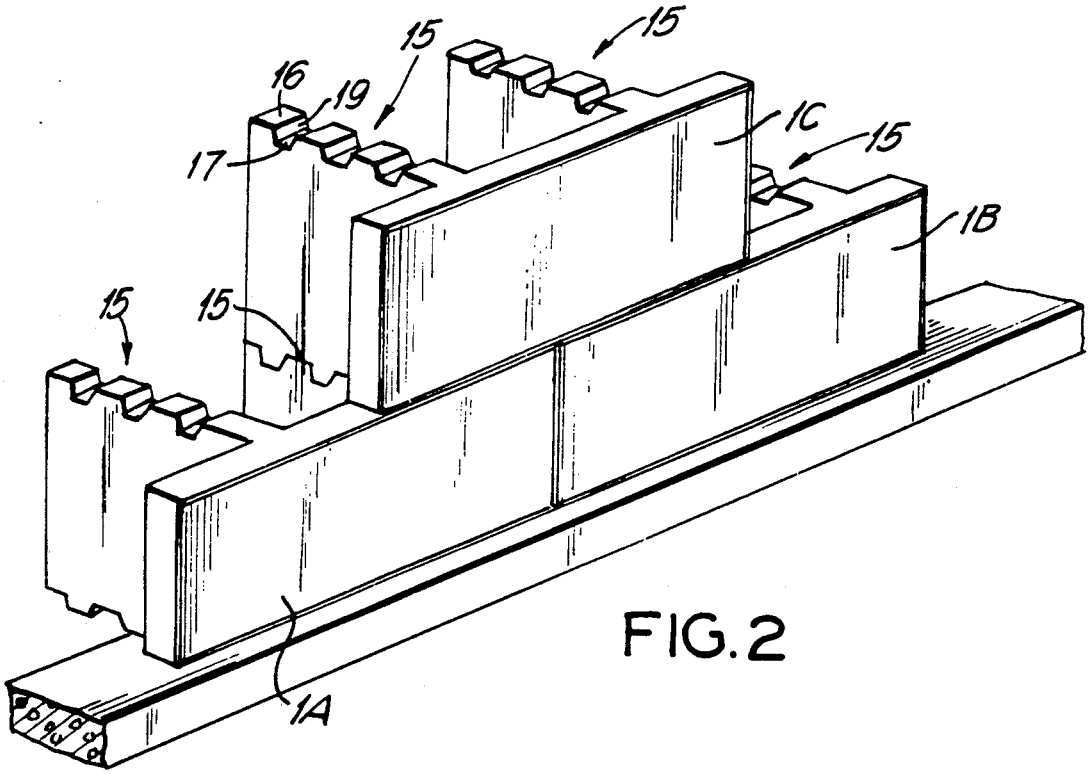
FIGS. 2 is a front perspective view of the portion of a vertical retaining wall configured from a "brick-bonded" assembly of construction elements, shown in FIG. 1.

Referring to FIGS. 1A and 1B, there is shown one embodiment of the retaining wall construction element of the present invention. As illustrated, the construction element 1 has a face panel 2 which is a prismatic solid having a front wall 3, a rearward wall 4, side walls 5, 6, and top and bottom walls 7 and 8, respectively. Orthogonally protruding from the rearward wall 4 of the face panel 2, are two spaced apart members (i.e. arms) 9, which are also prismatic solids, each having a back wall 10, side walls 11, 12, an upper wall 13, and a lower wall 14, as shown. The length (i.e. height) of the face panel side walls 11, 12 are equal to the height of the front wall 2 of each protruding arm in order to provide a completely closed-off retaining wall surface when the construction elements are configured together, as shown in FIG. 2. However, in other embodiments of the present invention, to be disclosed hereinafter, the height of the face panel can be made lower than the height of the front wall of the protruding arms, to provide several surprising advantages.

As illustrated in FIGS. 1A and 1B, the plane of the face panel 2 is disposed substantially orthogonal to both the upper and lower walls 13 and 14 of the protruding arms 9. However, in other embodiments of the present invention disclosed hereinafter, the angle of the face panel with respect to the upper and lower walls of the protruding arms, can vary to provide a different facial appearance and surprisingly significant advantages. Thus, depending on the shape and characteristics of any particular retaining wall, the physical dimensions of the construction element can be varied to provide a desired facial appearance.

In addition to the face panel 2 and protruding arms 9, the construction element illustrated in FIGS. 1A and 1B further includes engaging means 15 disposed on the upper and lower walls of each protruding arm 9. Such engaging means facilitate stacking of at least a portion of the protruding arm of one construction element on top of at least a portion of the protruding arm of another construction element, and prevents relative sliding and movement therebetween. In the preferred embodiments, the "engaging means" 15 are realized in the form of a saw-tooth notched pattern formed in the upper and lower walls 13 and 14, respectively. As shown in FIG. 1B, these saw-tooth notched patterns 15 comprise alternating (i) projections formed by, for example, projecting planar surfaces 16, and (ii) indents formed by, for example, non-projecting planar surfaces 17, with transition sloped surfaces 19 therebetween. These saw-tooth notched patterns 15 facilitate the selective stacking of the construction elements 1 on top of one another in a variety of different configurations, as will be illustrated hereinafter.

Of the multiple configurations that are possible, FIG. 2 illustrates a portion of a vertical retaining wall formed from an assembly of construction elements 1. Such a retaining wall is configured using a "brick-bonded" stacking arrangement consisting of retaining wall construction elements 1A and 1B being side by side with element 1C stacked on one protruding arm of each of the elements IA and 1B. As illustrated in FIG. 2, the saw-tooth notched pattern in lower wall of protruding arm 9 of element 1C, interengages with the saw-tooth notched pattern in the upper wall of protruding arm 9 of construction element IA. A similar interengagement will occur for saw-tooth notched patterns in other stacked protruding arms. This pyramid-type stacking of construction elements adds additional structural strength to the wall. Notably, while the front panels of these three construction elements are all disposed in substantially within the same plane, other possible configurations are possible, by stepping back element 1C from elements 1A and 1B, and so on. This simply involves interengaging the forward most portions of the saw-tooth notched patterns on the lower walls of construction element 1C, with the rearward most portions of the saw-tooth notched patterns in the upper walls of construction elements 1A and 1B. Examples of such possible configurations will be illustrated in great detail hereinafter.

Figure 3A:
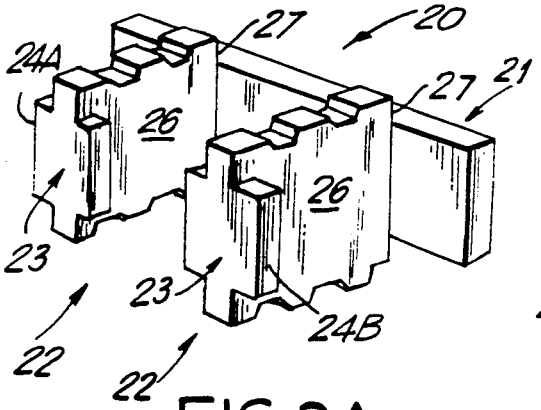
FIGS. 3A is a rear perspective view of another embodiment of the retaining wall construction element of the present invention, showing each protruding arm to have an integrally formed soil anchoring projection in the form of a "T" shaped structure.
Figure 3B:
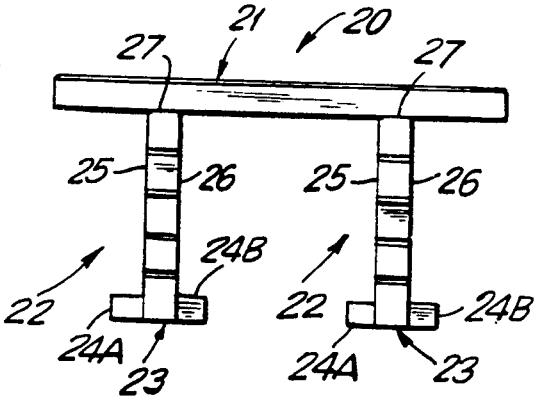
FIG. 3B is a plan view of the construction element shown in FIG. 3A.

Referring to FIGS. 3A and 3B, another embodiment of the construction element of the present invention is shown. In this particular embodiment, each construction element 20 includes a face panel 21 and a pair of protruding arms 22. Each protruding arm has engagement means 15 as described hereinabove and integrally formed soil anchoring means 23 projecting from the rear portion of the side walls, as shown. In this particular embodiment, each protruding arm and integrally formed soil anchoring means comprises a prismatic substructure generally in the shape of a "T", as best shown in FIG. 3B. The top portion of the "T" is realized by a pair of stems 24A and 24B projecting orthogonally from the rear portion of the side walls 25 and 26.

As shown in FIG. 3A, the height of the face panel 21 is less than the height of the front wall 27 of each of the protruding arms 23, and preferably provides equal exposure of the front walls 27 above and below the face panel 21. This structural feature permits use of substantially less concrete in forming the construction elements, thereby resulting in lighter, less expensive structures, while permitting use of other functionally equivalent materials which can provide desired decorative functions.

Figure 4:
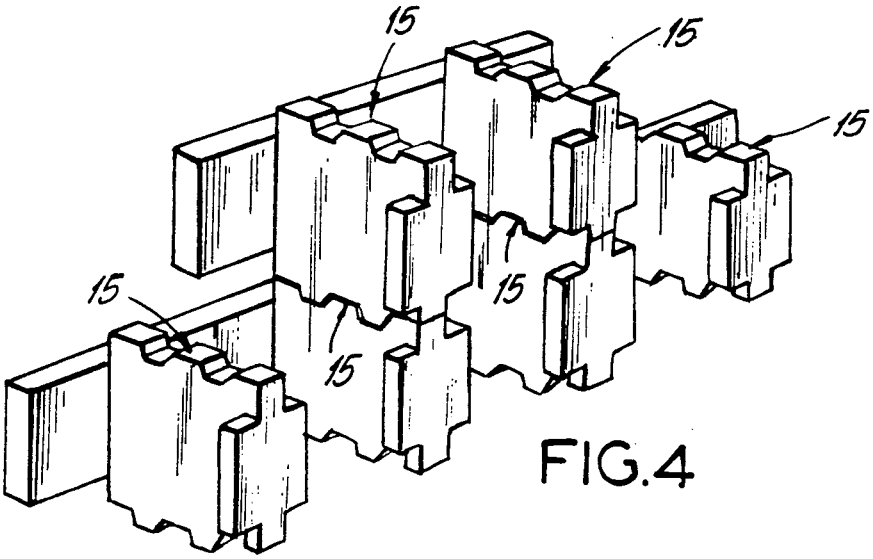
FIG. 4 is a rear perspective view of a vertical retaining wall configured from a brick-bonded assembly of the construction elements shown in FIGS. 3A and 3B.

In FIG. 4, a portion of a vertical retaining wall is shown formed from a three level array of construction elements illustrated in FIGS. 3A and 3B. As illustrated in this particular "brick-bonded" configuration, the saw-tooth notched patterns (i.e. engaging means) 15 interengage, as in the "stack-bonded" configuration shown in FIG. 2. In effect, the interstacking of these soil anchors 23, provide addition rigidity to the overall retaining wall when back fill soil is installed.

Figure 5A:
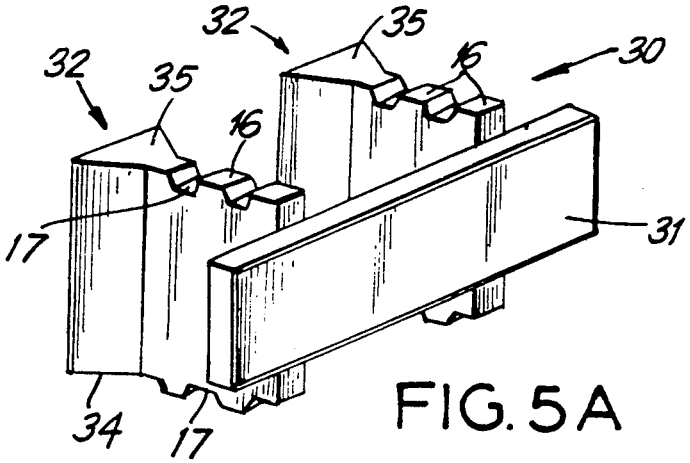
FIG. 5A is another embodiment of the retaining wall construction element of the present invention, showing each protruding arm to have integrally formed soil anchoring projection in the form of a V-shaped flared structure, and the height of the face wall being lower than the height of each protruding arm.
Figure 5B:
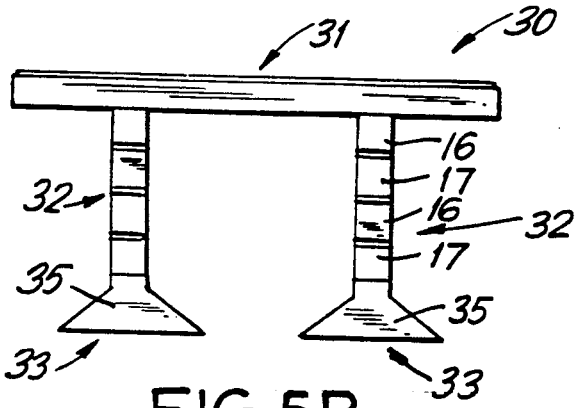
FIG. 5B is a plan view of the construction element of FIG. 5A.
Figure 5C:
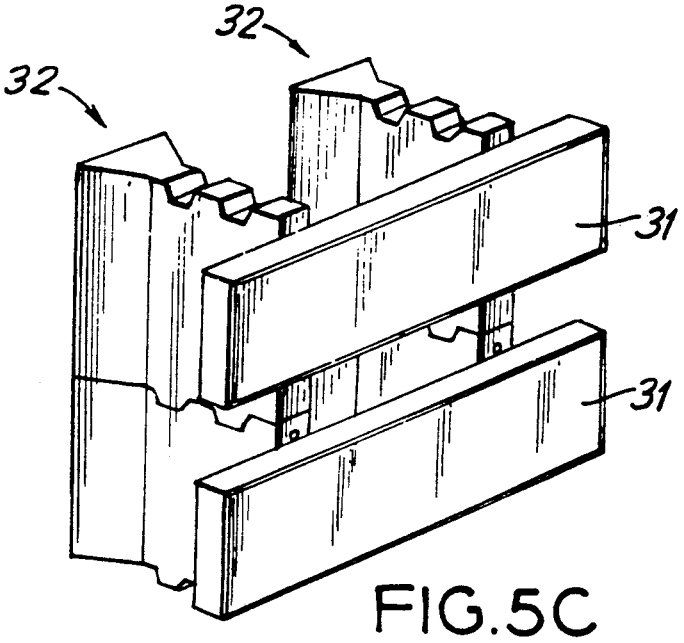
FIG. 5C is a front perspective view of a portion of a vertical retaining wall configured from a "stack-bonded" assembly of the construction element shown in FIG. 5A and 5B.

Referring to FIGS. 5A and 5B, another embodiment of the retaining wall construction element of the present invention is shown. This construction element 30 has a face panel 31 and protruding arms 32 with engaging means 15 as described above. In addition, each protruding arm 32 has a soil anchoring means 33 realized in the embodiment, as a V-shaped flared structure of longitudinal extent integrally formed with the rear wall of each protruding arm. These soil anchoring means 33 serve to anchor each construction element securely within soil mass used to fill behind the face panels. Also, in order that each construction element may be stacked upon another construction element, as shown in FIG. 5C, the bottom portion 34 of the flared structure 32 is made to lie substantially within or above the plane of the non-projecting planar surfaces 17 of engaging means 15 as illustrated in FIGS. 5A and 5B, in particular. Notably, however, the top portion 35 of the flared structures can be made to lie substantially within or below the plane of the projecting planar surfaces 16 of the engaging means. FIG. 5C shows a vertical retaining wall formed by stacking two construction elements 30, one on top of the other in a non-stepped manner.

Figure 6A:
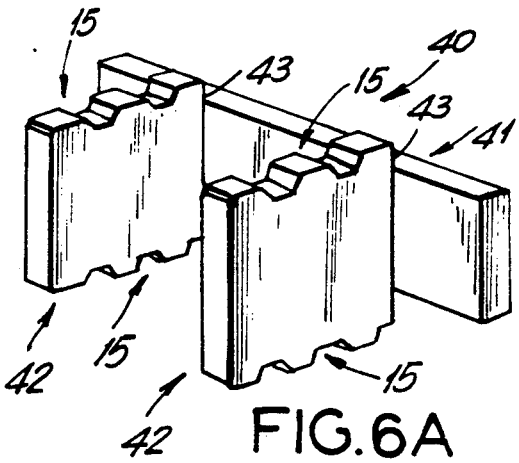
FIG. 6A is a rear perspective view of another embodiment of the retaining wall construction element of the present invention, showing the protruding arms having integrally formed engagement means on the upper and lower walls thereof, and the height of the face panel being lower than the height of the protruding arms.
Figure 6B:
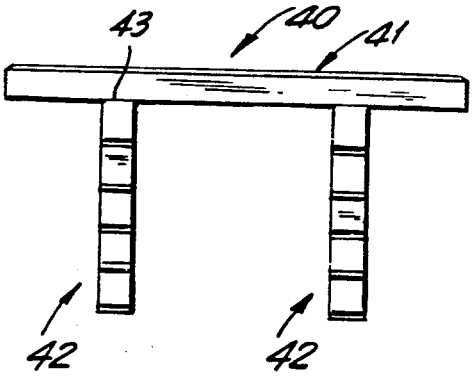
FIG. 6B is a plan view of the construction element shown in FIG. 6A.

Referring to FIGS. 6A and 6B, another embodiment of the retaining wall construction element of the present invention, is shown. The construction element 40 has a face panel 41 and a pair of protruding arms 42, as described hereinabove. Each protruding arm 42 has saw-tooth notched patterns as engaging means 15 and the height of the face panel 41 is less than the height of the front walls 43 of the protruding arms. Aside from the reduction in the height of the face panel, construction element of FIGS. 6A and 6B is in all respect similar to the construction element of FIGS. 1A and 1B.

Figure 7A:
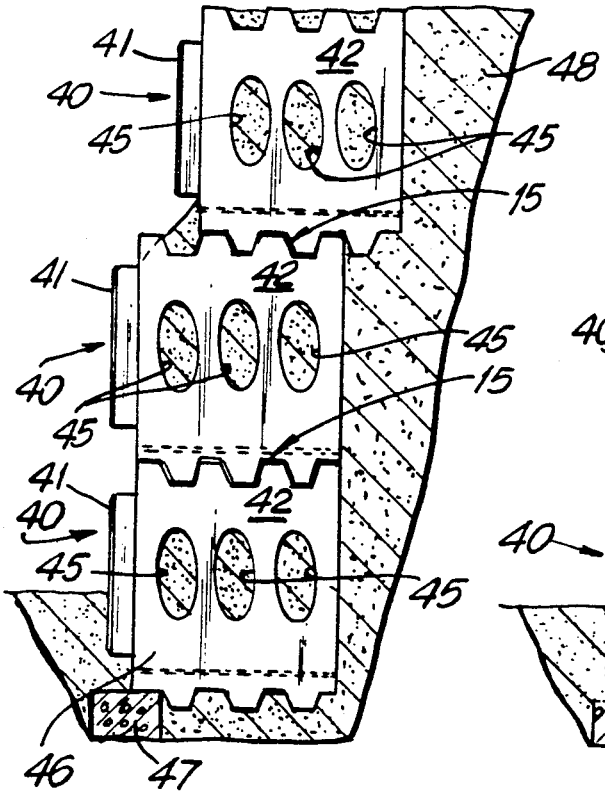
FIG. 7A is an elevated side view of a hybrid vertical-stepped retaining wall configured from the construction elements shown in FIG. 6.

In FIG. 7A, a hybrid vertical-stepped retaining wall is illustrated. In this configuration, each of the three construction elements 40 shown in FIGS. 6A and 6B, have protruding arms 42 provided with holes 45 which allow for soil dispersion therethrough. In addition, these holes 45 substantially reduce the weight of each construction element. As shown, the front portion 46 of each lower most construction element is mounted on a concrete foundation or footing 47 which ensures that each construction element positioned on the lower most course of the wall, is maintained level with each other. While the first and second level of construction elements are stacked so that their respective face panels 41 are "flush" with each other, the third level of construction elements are stepped back one saw-tooth notch, for purely aesthetic considerations. Notably, however, reasons for stepping back the construction elements can be for effectively shifting the center of gravity of the resulting wall structure back towards the soil mass 48 in order to counteract wall overturning moments created by soil loading conditions on the wall.

Figure 7B:
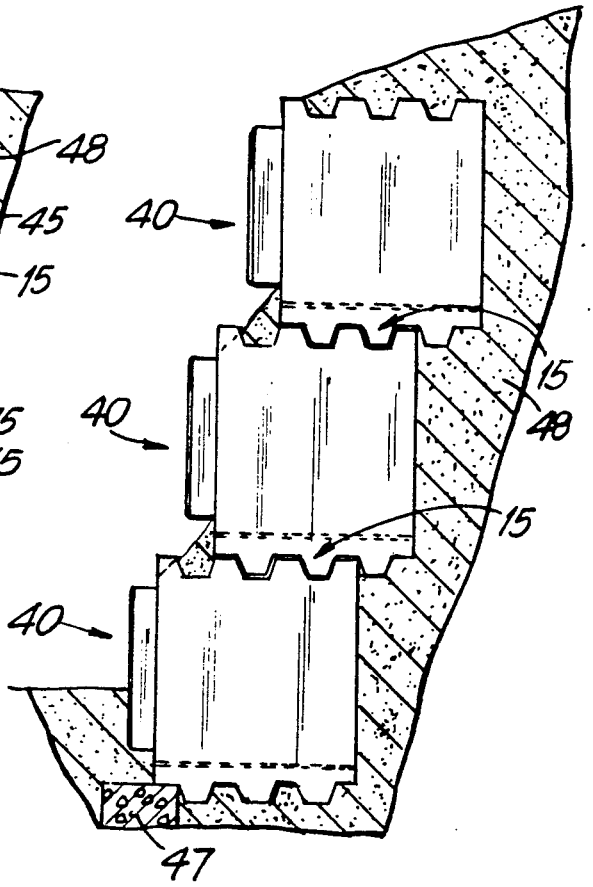
FIG. 7B is an elevated side view of a "stepped" retaining wall configured from the construction element shown in FIG. 6.

As illustrated in FIG. 7B, construction elements of FIGS. 6A and 6B are stacked upon each other in a stepped-back relationship to produce a stepped wall configuration having three levels. This is achieved by simply interengaging the saw-tooth notched patterns 15 of one protruding arm with a selected portion of the saw-tooth notched patterns of a corresponding arm in the stepped back array. While this stepped configuration can be used to construct a retaining wall satisfying a variety of aesthetic concerns and conditions, the stepped configuration employed in the application illustrated in FIG. 7B has been primarily to shift the center of gravity of the resulting wall backwards in the direction of the soil fill mass 48, thereby enhancing the structural stability of the retaining wall under severe soil loading conditions.

Figure 8C:
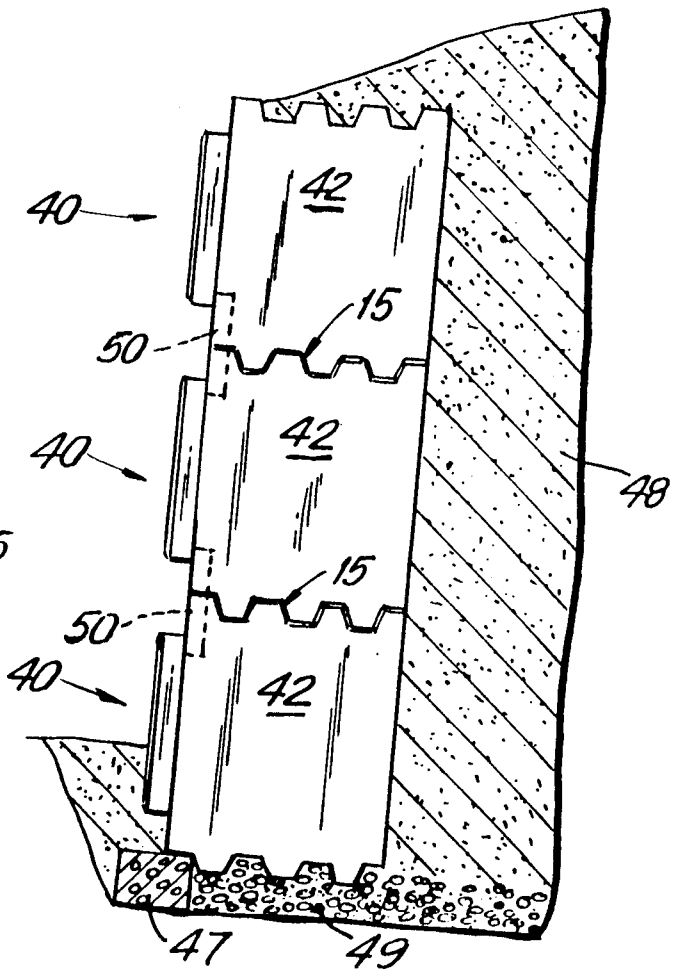
FIGS. 8A, 8B and 8C show elevated side views of a retaining wall configured from a "stack-bonded" assembly of the construction elements shown in FIG. 6.
Figure 8B:
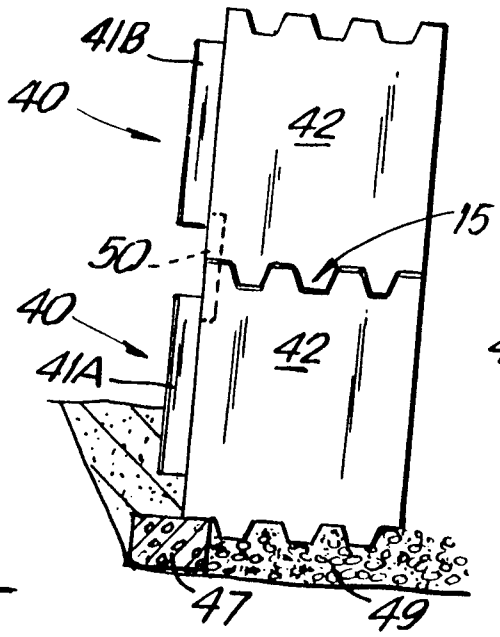
Figure 8A:
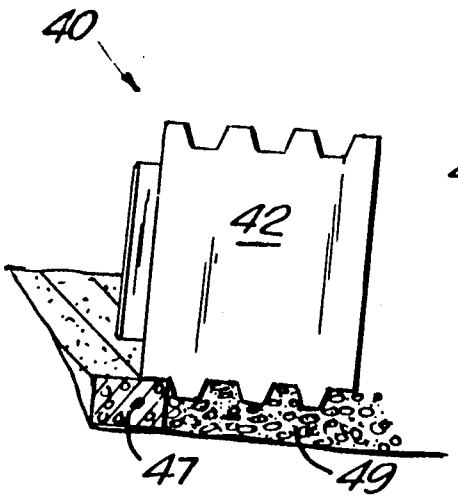

Referring to FIGS. 8A through 8C, a general method is illustrated for constructing a retaining wall using the construction elements of the present invention. While the construction of a "battered" (i.e. backwardly tilted) wall is illustrated in these drawings, the general approach can be applied to the construction of virtually any type of retaining wall using any of the construction elements of the present invention.

First, soil is excavated in a manner known in the art, for the purpose of pouring or laying down a concrete footing or foundation generally indicated by 47. An appropriate construction base such as crushed gravel 48 is then laid down beyond the footing 47 and graded as desired. Then, the first course of construction elements, for example 40, are set in place in a side-by-side relationship. As shown in FIG. 8A, the bottom front portion of each protruding arm is set upon the footing 47 as illustrated, with each construction element tilting backwardly at predetermined angle determined essentially by the foundation grade. Soil mass 49 of appropriate constitution (i.e., one which prevents hydrostatic buildup behind the retaining wall) is then deposited behind the face panel and within the open-cavities of the lower course of construction elements, and thereafter is compacted in a conventional manner. As illustrated in FIG. 8B, a second course of construction elements are then stacked upon the first course of construction elements, with the saw-tooth notched patterns 15 of each element interengaging in a manner hereinbefore described. A longitudinally extending planar face insert 50, for example, treated timber or treated steel, is then inserted behind the upper rear portion of face panel 41A and the lower rear portion of face panel 41B, as shown. A subsequent layer of soil is then filled behind and against the face panels 41 and 41B and face insert 50, and thereafter compacted to maintain the face insert 50 in its desired position. Alternatively, a face insert of suitable dimensions can be fastened to the exposed front wall surfaces of the protruding arms, using suitable fasteners. The above process is repeated for the subsequent levels of construction elements until the retaining wall is completed, as illustrated in FIG. 8C.

In the various embodiments of the construction elements described hereinabove, the face panels are substantially perpendicular (i.e., orthogonal) to the upper and lower walls of the protruding arms, constraining to some extent the type of retaining wall surfaces that can be constructed. However, in accordance with the present invention, the face panels of construction elements can be disposed at an obtuse angle with respect to the upper (or lower) wall of the protruding arm to provide a wider variety of possible construction elements.

Figure 9B:
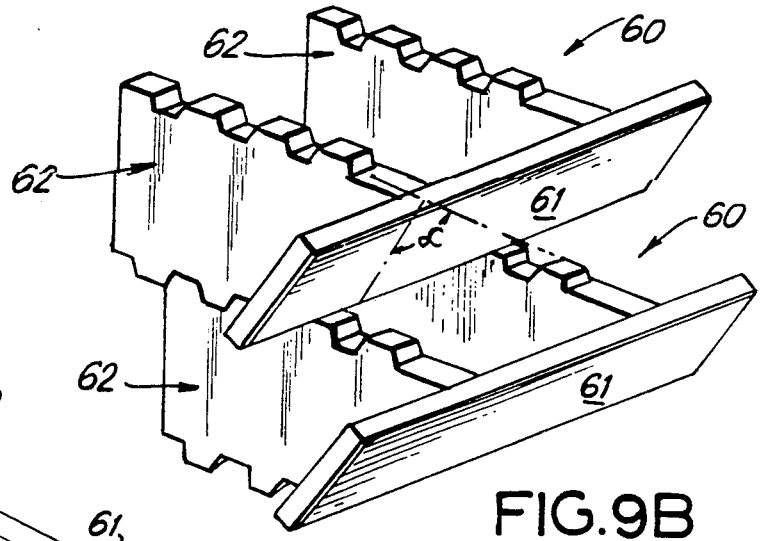
FIG. 9B is a perspective view of the pair of construction elements in FIG. 9A, shown "upwardly" configured and interengaged with one another in a "stepped" manner.
Figure 9A:
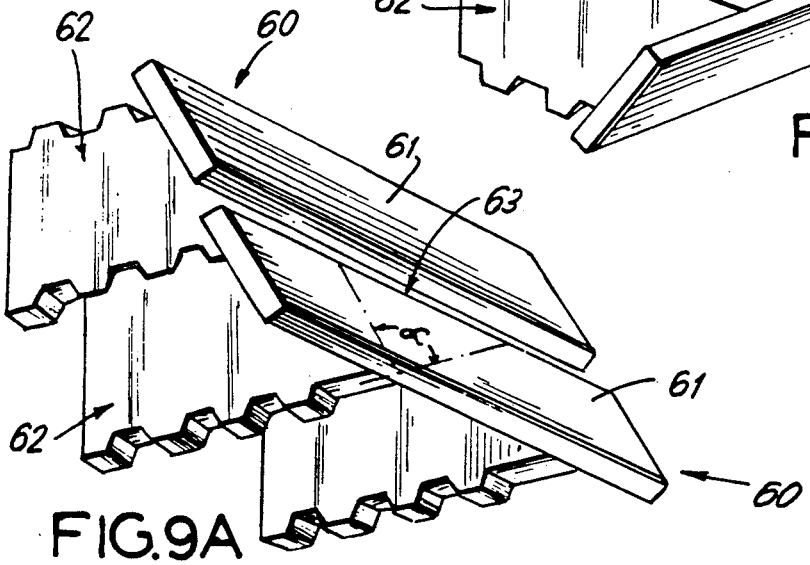
FIG. 9A is a perspective view of a pair of construction elements of another embodiment of the present invention, each having a face panel which is disposed at an angle with respect to the upper wall panel of the protruding arms, and shown "downwardly" configured and interengaged with one another in a "stepped" manner.

For example, in FIGS. 9A and 9B two such construction elements 60 are shown interengaged, with the face panels of each construction elements 60 being disposed at an obtuse angle. As shown, the height of each face panel 61 is equal in length with the front wall of each protruding arm 62. In this manner, a relatively narrow longitudinally extending gap 63 is created between such construction elements when they are stacked in a staggered fashion with the face panels "downwardly" extending, as illustrated in FIG. 9A. As described above in connection with FIGS. 8A through 8C, face inserts can be provided behind the face panels to occlude such a gap, to achieve aesthetic considerations such as using a combination of wood and concrete materials, while reducing the weight of each construction element. In FIG. 9B the same two construction elements shown in FIG. 9A are stacked together in staggered fashion, however in this configuration, the face panels are "upwardly" extending to provide between contiguous levels of construction elements, a terrace which can be used for planting and other aesthetic functions.

Figure 10A:
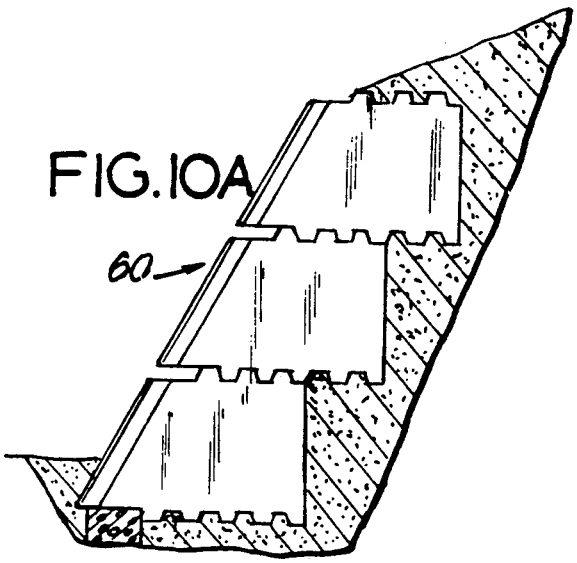
FIG. 10A is an elevated side view of a stepped-back retaining wall configured from the construction elements shown in FIGS. 9A and 9B, with the face panels downwardly configured to provide a retaining wall surface with a substantially uniform slope.
Figure 10B:
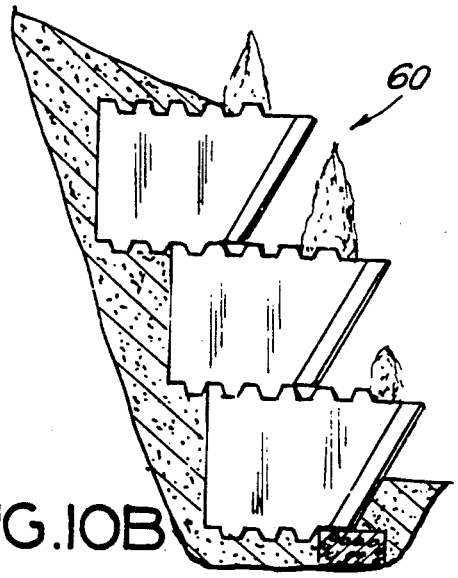
FIG. 10B is an elevated side view of a stepped-back retaining wall configured from the construction elements shown in FIGS. 9A and 9B, with the face panels upwardly configured to provide a terrace at each wall level, for landscaping purposes.

FIG. 10A illustrates an ascending retaining wall formed from stacking, in a stepped configuration, three levels of construction elements shown in FIGS. 9A and 9B. Notably, by stepping the middle and upper levels of construction elements back two notches, a substantially planar retaining wall surface is provided with its angle of ascent being substantially equal to the face angle $\alpha$ of each construction element 60. FIG. 10B illustrates a stepped retaining wall employing the construction elements of FIGS. 9A and 9B, configured with the face panels upwardly extending along the height of the retaining wall.

Figure 11:
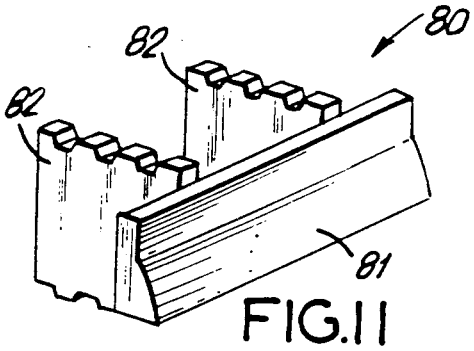
FIG. 11 is a front perspective view of another embodiment of the construction element of the present invention, showing each protruding arm having engaging means and an integrally formed face panel realized in the form of a highway safety guard rail.
Figure 12:
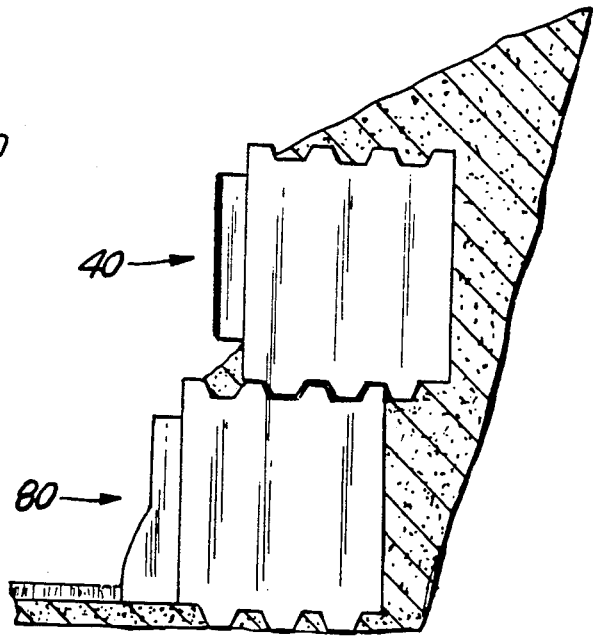
FIG. 12 is an elevated side view of a stepped-back retaining wall configured from the construction elements shown in FIGS. 6 and 11.

In FIG. 11, there is shown another embodiment of the construction element of the present invention. The construction element 80 comprises a face panel 81 realized in the form of a highway safety guard rail, and a pair of protruding arms 82 attached thereto and having engaging means 15 as described hereinbefore with respect to the other embodiments. FIG. 12 illustrates a stepped-back retaining wall formed from stacking, alongside a highway, two levels of construction elements 80 and 40 shown in FIGS. 11 and 6A, respectively. In this particular application, the level of construction elements 40 are stepped back only one notch in the engaging means 15, to provide a desired degree of terracing.

In many applications, the height of the retaining wall to be built will exceed the height of one or more construction elements stacked upon each other. In such circumstances, it is not uncommon for the load of the soil mass behind (and at times above) the retaining wall, to be so severe as to create substantial moments against the retaining wall which attempt to overturn it. In applications such as these, applicant has discovered that it is advantageous to employ a retaining wall and soil reinforcement subsystem illustrated in FIGS. 13A and 13B and generally indicated by reference numeral 70.

In general, each subsystem 70 comprises in cooperative association, a self-supporting construction element 71 (preferably of the type hereinbefore described), and at least one or more grid-like or matrix structures 72 which, due to their high strength and modulus, provides tensile reinforcement to soil structures disposed behind the subsystem 70, thereby reducing potential failure planes which operate to create overturning moments against the retaining wall. When stacked together as shown in FIG. 14B, the subsystems 70 act as a system of distributed anchorage within a soil matrix.

Figure 13A:
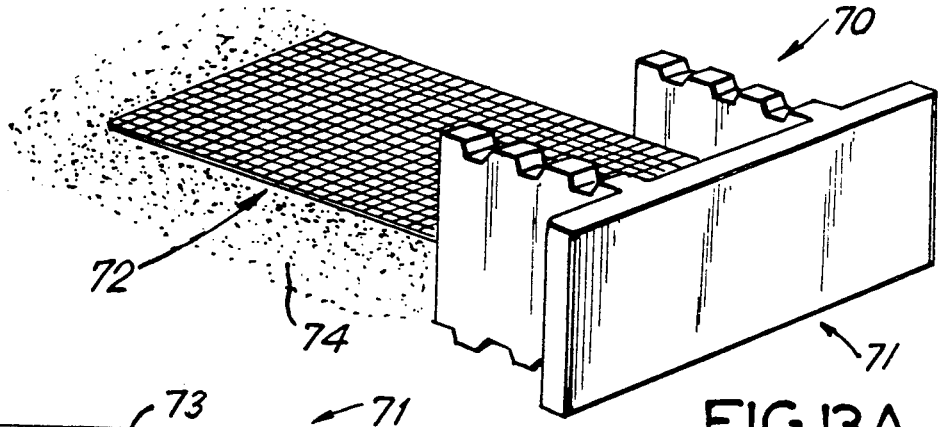
FIG. 13A is a front perspective view of a retaining wall and soil reinforcement subsystem of the present invention, showing the free-standing construction element of FIG. 6 disposed in a non-connecting, intercooperative relationship with a soil interlocking grid structure.

In application, each layer of grid structure 72 is preferably positioned within the open cavity 73 of the self-supporting construction element 71 and upon a layer of a soil structure 74 which has been laid down and compacted, as illustrated in FIG. 13A. However, the exact position of each grid structure 72 beyond the face panel of each construction element 71 can vary in each application. Upon the grid structure 72, another layer of soil structure is laid down and compacted, with a second grid structure and layer of soil structure being installed above the first, and so on. When the grid structures are installed in the soil fill beyond the retaining wall, the grid geometry interlocks with adjacent soil to create a soil-grid composite structure which is self-supporting (i.e. free-standing) and stable. Such grid structures are commercially available from The Tensar Corporation of Morrow, Ga., under the tradename TENSAR® Geogrids, and are constructed from high density polyethylene materials which are not effected by chemicals or organisms normally occurring in the soil, and thus will not corrode or degrade during the life of the retaining wall structure.

Figure 14A:
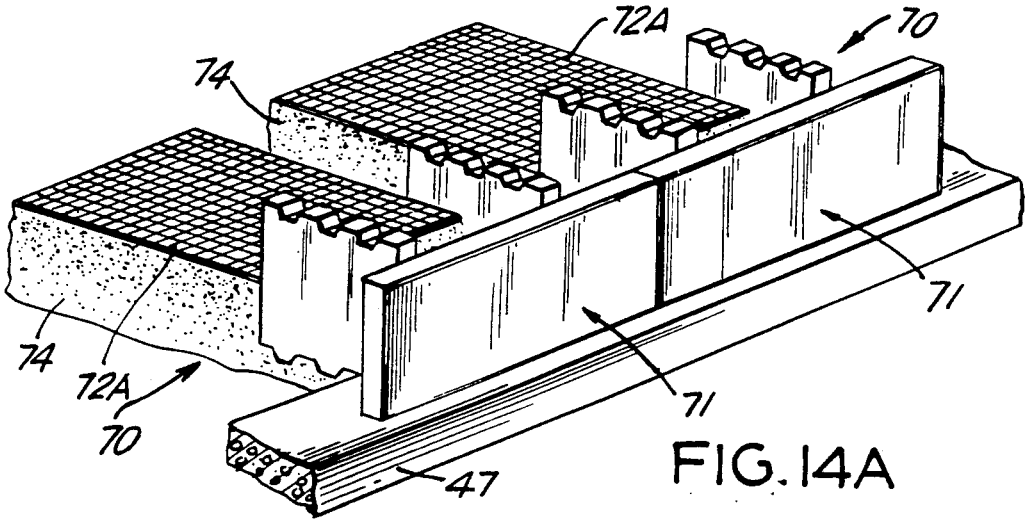
FIG. 14A is a front perspective view of a portion of the bottom level of a vertical retaining wall, configured from two retaining wall and soil reinforcement subsystems shown in FIGS. 13A and 13B.
Figure 14B:
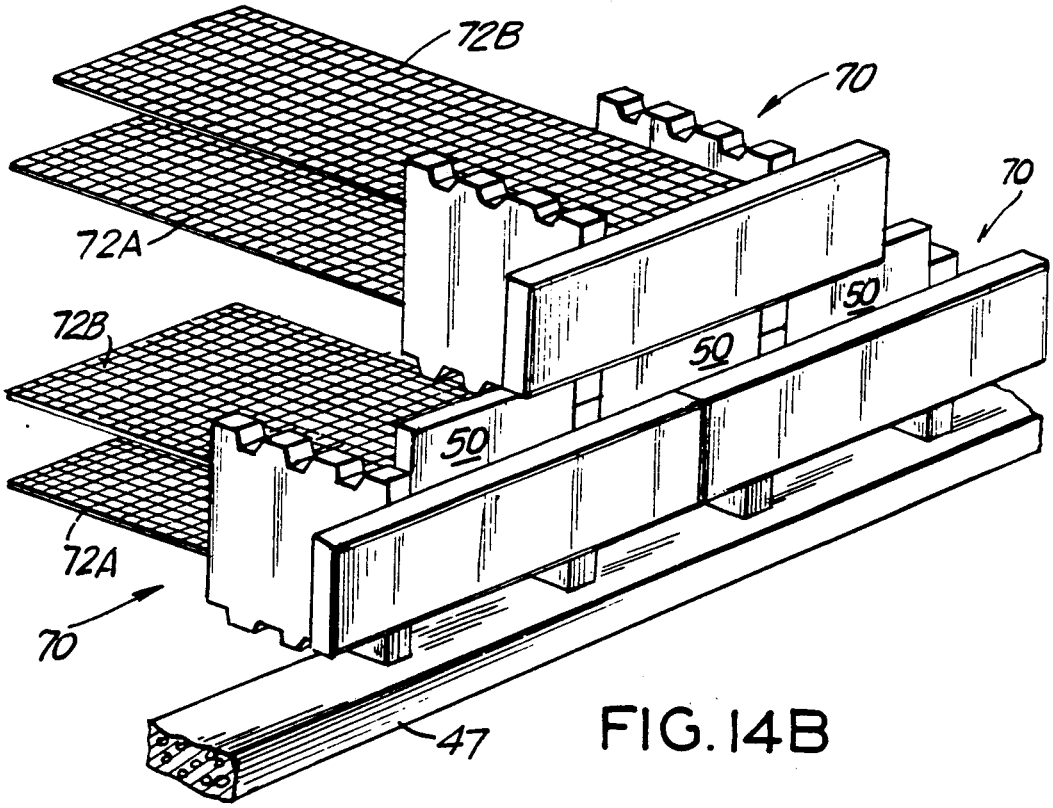
FIG. 14B is a front perspective view of a portion of the retaining wall of FIG. 14A, shown with an additional retaining wall and soil reinforcement subsystem installed upon the bottom course in a brick-bonded stacking manner.

As illustrated in FIG. 14B, each subsystem 70 used to form the vertical retaining wall, employs two layers of grid structures 72A and 72B; although in particular applications, it is understood that more or less of these grid structures may be used to achieve a required degree of soil reinforcement. Clearly however, the exact number of grid structures to be installed behind each face panel of any particular retaining wall design, will depend on considerations including back-fill soil characteristics, soil loading conditions on the retaining wall, and the height of the resulting wall structure.

Important to the understanding of this embodiment of the present invention, is that when co-operating together as a system, each subsystem 70 contributes in keeping soil pressures against the face panels of its construction element 71, to a minimum. In effect, regardless of the height of resulting retaining wall, each free-standing construction element 71 only experiences, at worst, the loading attributed to soil mass within and about its open cavity 73. Thus, advantageously, using the subsystem 70 of the present invention, it is now possible to construct vertical and other types of retaining walls having heights exceeding 70 or more feet, while using any type of free-standing construction element having an open-cavity structure defined by multiple protruding arms.

Figure 13B:
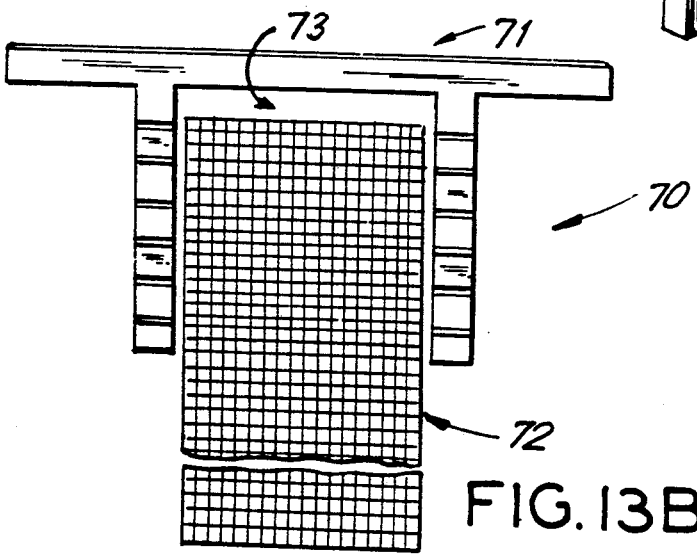
FIG. 13B is a plan view of the retaining wall and soil reinforcement subsystem shown in FIG. 13A.
Figure 15:
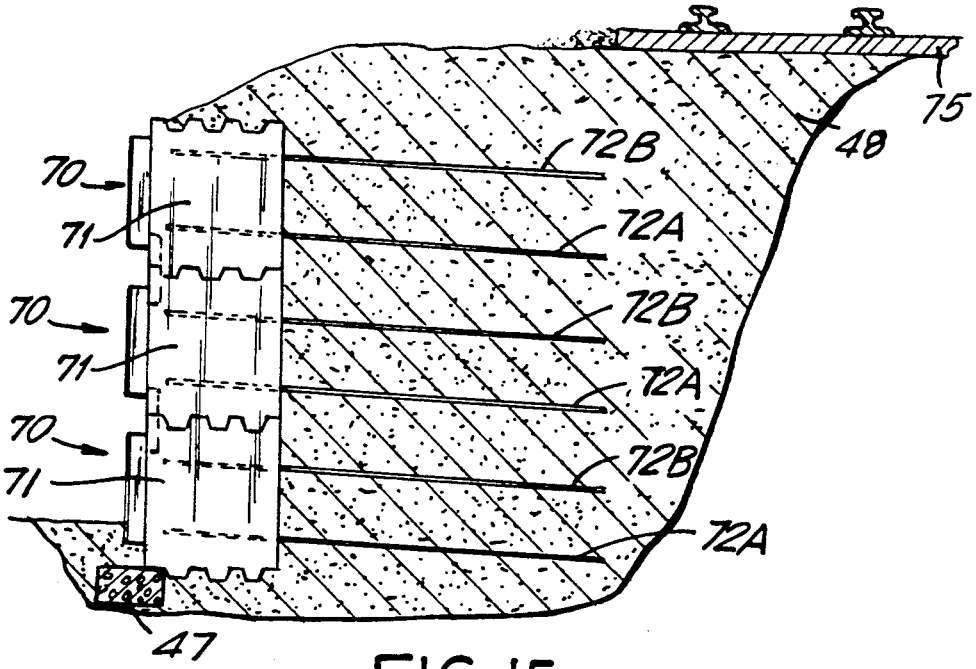
FIG. 15 is an elevated side cross-sectional view of a retaining wall shown supporting soil mass beneath a section of railroad track, and configured using three levels of retaining wall and soil reinforcement subsystems illustrated in FIGS. 13A and 13B.

Referring to FIG. 15, there is illustrated a vertical retaining wall formed by stacking the subsystem 70 illustrated in FIGS. 13A and 13B, along courses three levels high to support a severe load, such as a railroad track 75. As illustrated, the grid structures 72A and 72B of each subsystem 70 are installed between compacted layers of soil, to create a self-supporting soil-grid composite structure which is free of potential failure planes. Notably, in the illustrative embodiment the grid structures 72A and 72B of each subsystem 70 are inclined at a slight angle, e.g. 5°–10° away from the horizontal, as this is believed advantageous to the stability of the overall wall system. However, as shown in the other embodiments, the grid structure may be installed substantially horizontally, with excellent results obtained.

Figure 16:
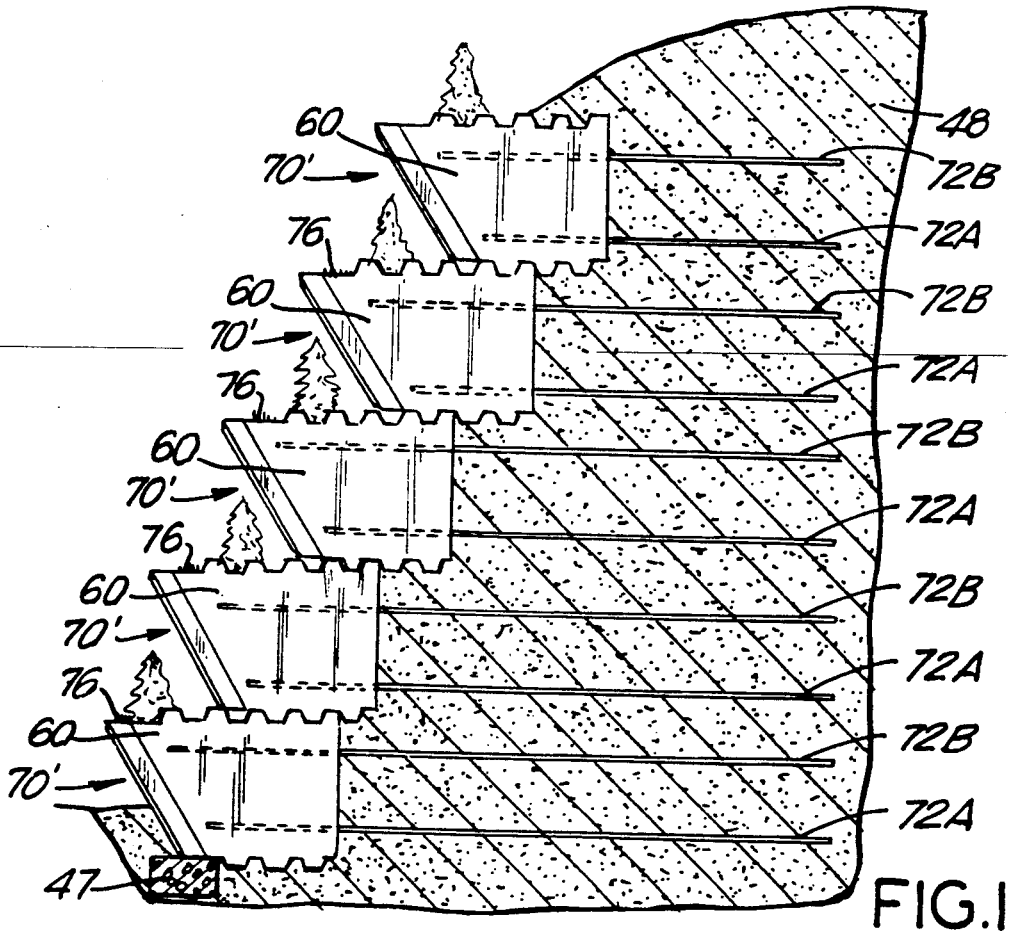
FIG. 16 is an elevated cross-sectional view of a staggered-terraced retaining wall shown supporting a heavy soil load, and which has been configured using five levels of retaining wall and soil reinforcement subsystems of the present invention based on the construction element of FIGS. 9A and 9B.
Figure 17:
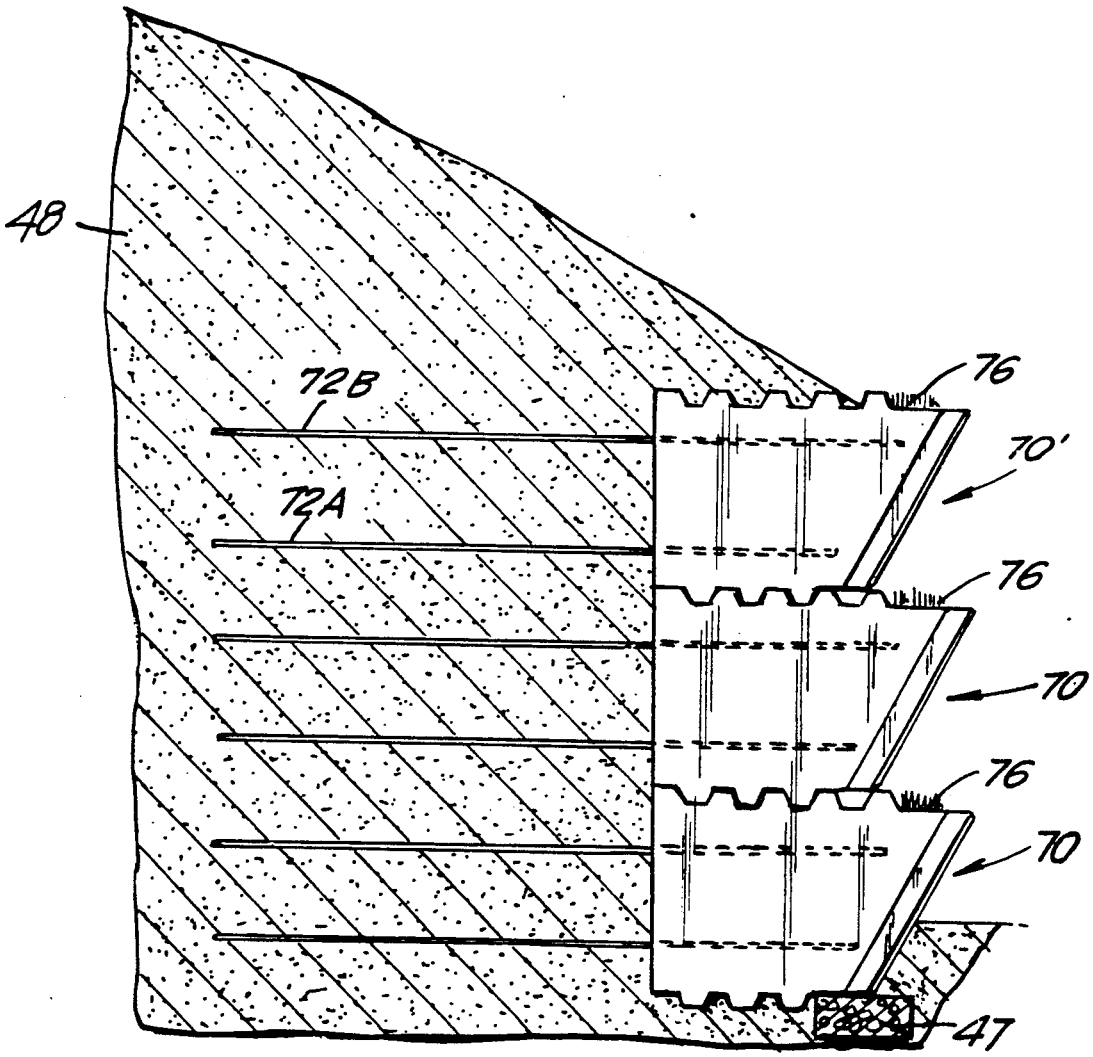
FIG. 17 is an elevated cross-sectional view of a vertical-terraced retaining wall shown supporting a heavy soil load, and configured using three levels of retaining wall and soil reinforcement subsystems of the present invention based on the construction element of FIGS. 9A and 9B.

In FIG. 16, an ascending terrace-wall is formed by stacking in a staggered manner, five levels of subsystems 70', each comprising (i) the construction element 60 illustrated in FIGS. 9A and 9B, and (ii) a pair of spaced apart grid structures 72A and 72B. In such a retaining wall system, a terrace 76 is formed at each level of the wall in which one is able to plant trees or shrubs provide for other types of landscaping. As illustrated in FIG. 17, it is also possible to stack the subsystems 70' of FIG. 16 with no staggering amongst contiguous construction elements, to provide a vertical terraced retaining wall system which is most advantageous where there are space limitations and terraces 76 are desired for planting.

Referring to FIGS. 18 through 31, another aspect of the present invention will now be described in connection with retaining wall applications where anchoring is either desired or required.

Figure 18:
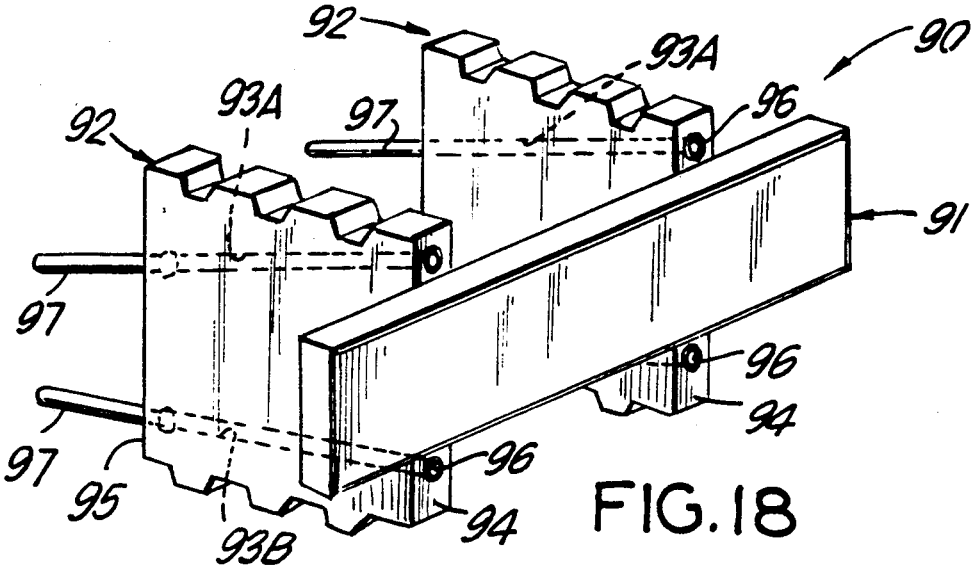
FIG. 18 is a perspective view of another embodiment of the construction element of the present invention showing each protruding arm having engaging means and a pair of passageways for insertion of tie-back rods into the soil or land formation behind the retaining wall.

In FIG. 18, there is shown yet another embodiment of the retaining wall construction element of the present invention. The construction element 90 includes a face panel 91 and multiple protruding arms 92 having the general characteristics of the construction element 40 shown in FIGS. 6A and 6B. In addition, each protruding arm 92 is provided with an upper and lower passageway 93A and 93B respectively, extending from front wall 94 to rear wall 95 as shown. The passageways 93A and 93B can have either a cylindrical or other cross-sectional geometry. Advantageously, since the height of the face panel 91 is less than the height of the front walls 94 of the protruding arms, entry holes 96 of each passageway are provided in the front wall 94 at locations left exposed by the face panel 91. In this manner, tie-back rods 97 can be inserted through the protruding arms without passing through the face panel itself. This is an important feature since insertion of the rods 97 through the arms typically require the use of power tools which can inadvertently cause surface damage to concrete about the entry holes. However, any surface damage that may be accidentally occasioned, can be easily covered by installation of a second layer of timber or like material over the face inserts installed behind the face panels of contiguous construction elements, illustrated in FIG. 19.

Figure 19:
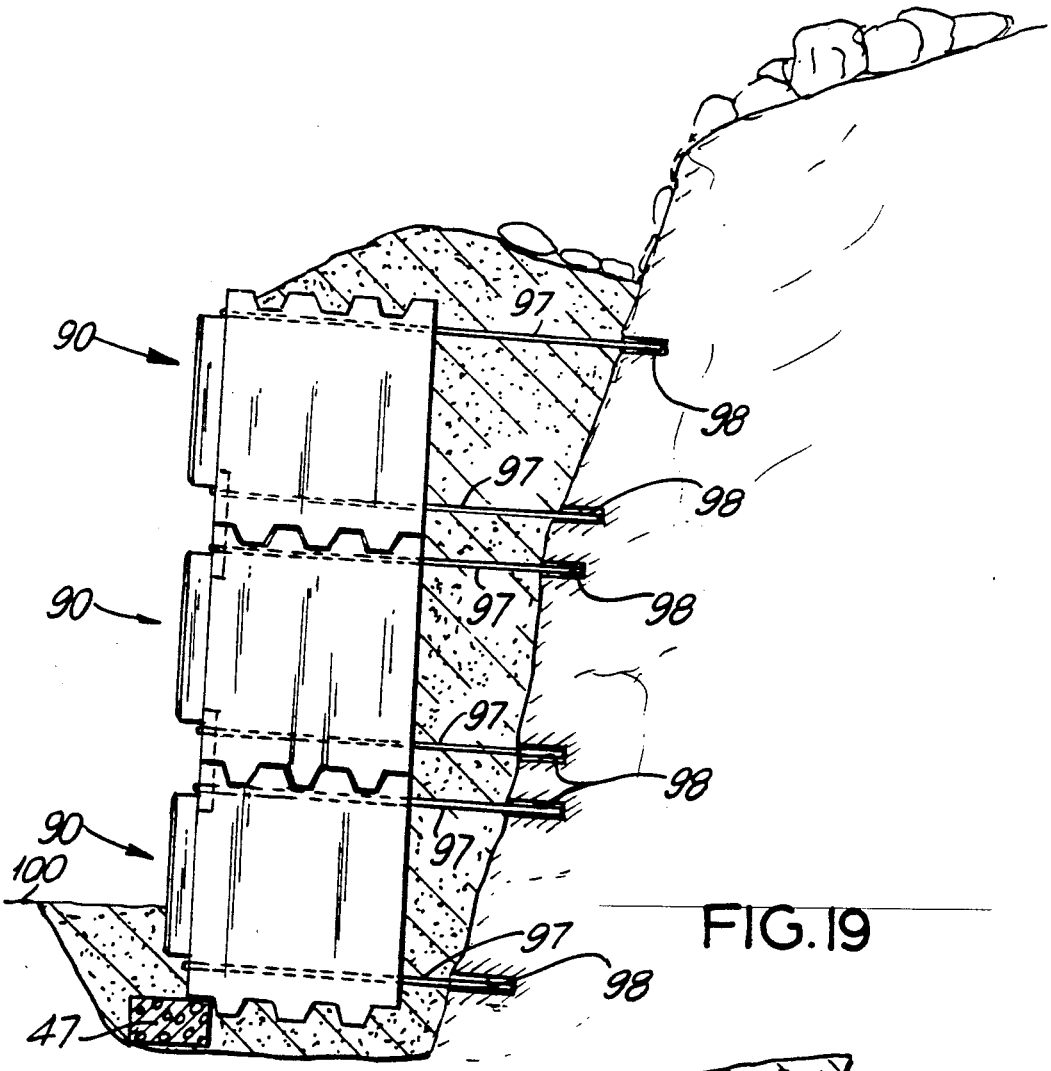
FIG. 19 is an elevated side cross-sectional view of a battered retaining wall configured using three levels of construction elements shown in FIG. 18, with tie-back rods passing through the passageways of the protruding arms and secured into rock formation behind the retaining wall.

As illustrated in FIG. 19, a vertical retaining wall is constructed between a roadway 100 and a steep rock formation. The retaining wall comprises three levels of the construction elements shown in FIG. 18, stacked upon each other in a non-staggered manner. Through passageways 93A and 93B of each protruding arm 92, tie-back rods 97 are inserted and conventionally driven into holes 98 drilled in the rock formation, essentially anchoring the individual construction elements into place. As shown, soil mass is filled behind the retaining wall, and the top soil is shaped for collection of fallen rocks.

Figure 20:
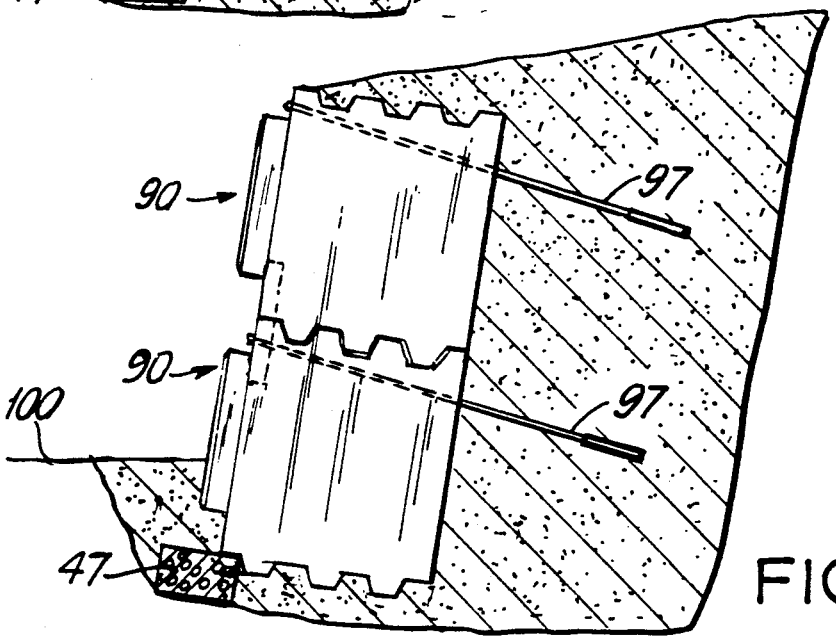
FIG. 20 is an elevated side cross-sectional view of a battered retaining wall configured using two levels of construction elements shown in FIG. 18, with tie-back rods passing through the passageways of the protruding arms and secured into soil mass behind the retaining wall.

As illustrated in FIG. 20, a "battered" retaining wall is constructed between a roadway and a steep land formation. The retaining wall comprises two levels of the construction elements shown in FIG. 18, stacked upon each other in a non-staggered manner. The lower course of construction elements are installed on concrete footing 47 in a similar manner described in connection with the retaining wall of FIGS. 8A through 8C. Through the passageways 93A and 93B of each protruding arm 92, the tie-back rods 97 are inserted and driven deeply into the land formation, essentially anchoring the individual construction elements into place. With such a retaining wall and anchoring system, severe loading conditions upon the wall can be adequately counteracted.

Figure 21:
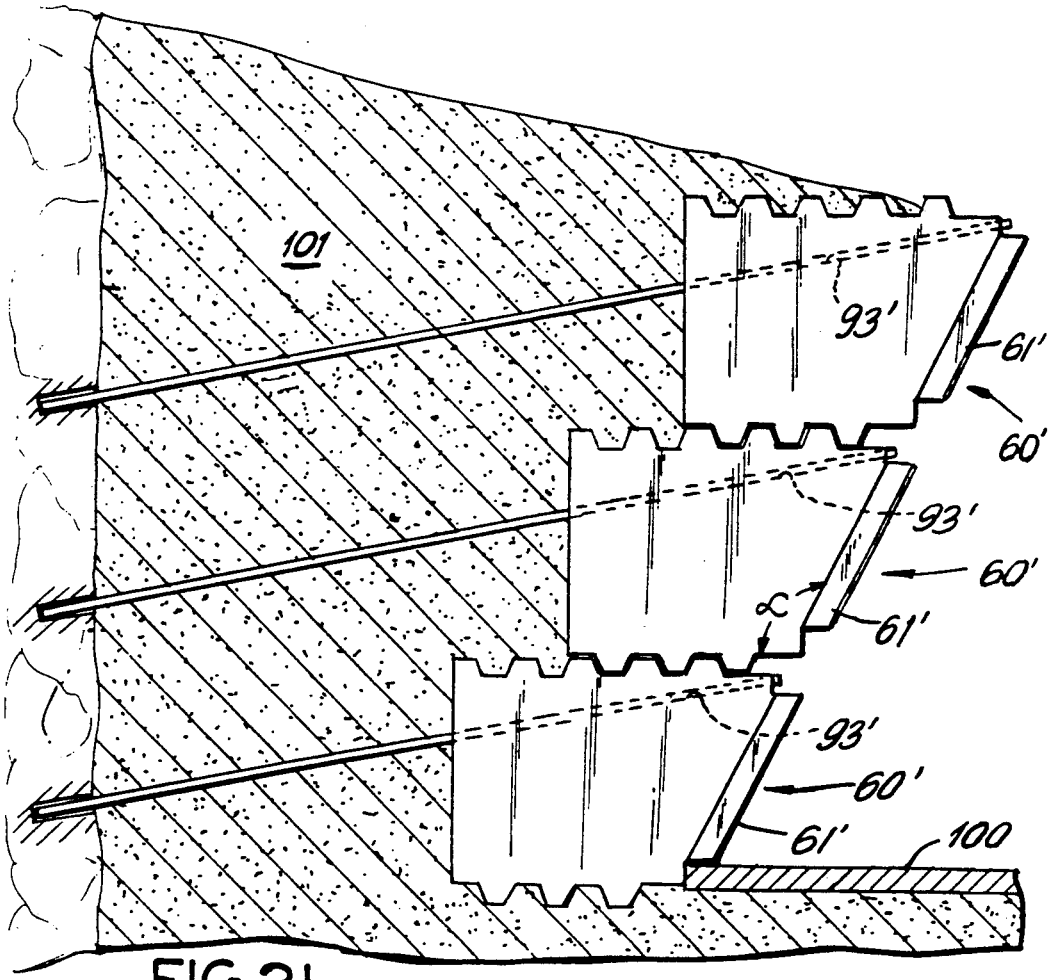
FIG. 21 is an elevated cross-sectional view of a "stepped-out" retaining wall formed by configuring three levels of the construction elements of FIGS. 9A and 9B having passageways in the protruding arms for insertion of tie-back rods which are driven into a land formation, such as rock.

Referring to FIG. 21, there is shown a "stepped out" retaining wall constructed between a roadway 100 and a land formation. The retaining wall comprises three levels of the construction elements 60', similar to those shown in FIGS. 9A and 9B, but also being provided with passageways 93'. Construction elements are staggered forward two notches per level, towards the roadway 100 so that the second and third levels actually extends outwardly and over a substantial portion thereof as shown. The face panels 61' of each construction element 60' are upwardly extending, and together form an outwardly ascending retaining wall surface, the angle of which with respect to the roadway being generally equal to the face angle $\alpha$ of each construction element. In order that the construction elements do not overturn due to moments exerted on the retaining wall by the soil load, an anchoring system is employed. As shown, the anchoring system comprises a plurality of the tie-back rods 97 passing through passageways 93' in each of the protruding arms, extending through fill soil 101 and secured into a land formation located beyond the retaining wall.

Figure 22:
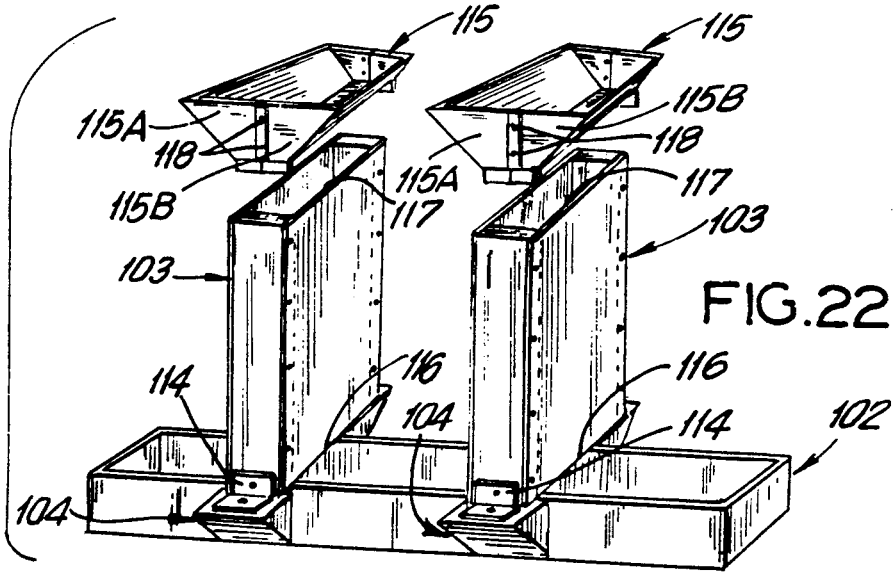
FIG. 22 is a perspective view of apparatus for molding one variety of retaining wall construction elements in accordance with the present invention.
Figure 23:
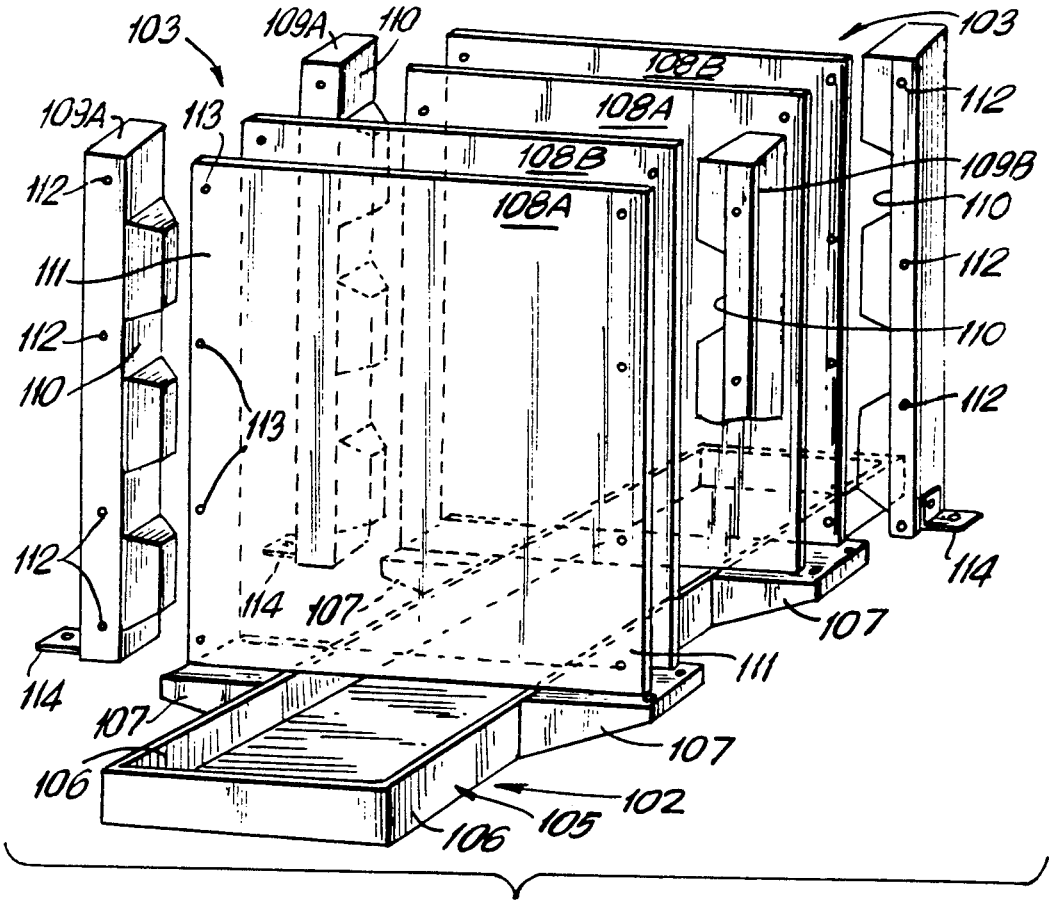
FIG. 23 is an exploded, partially broken away view of the molding apparatus shown in FIG. 22.
Figure 24:
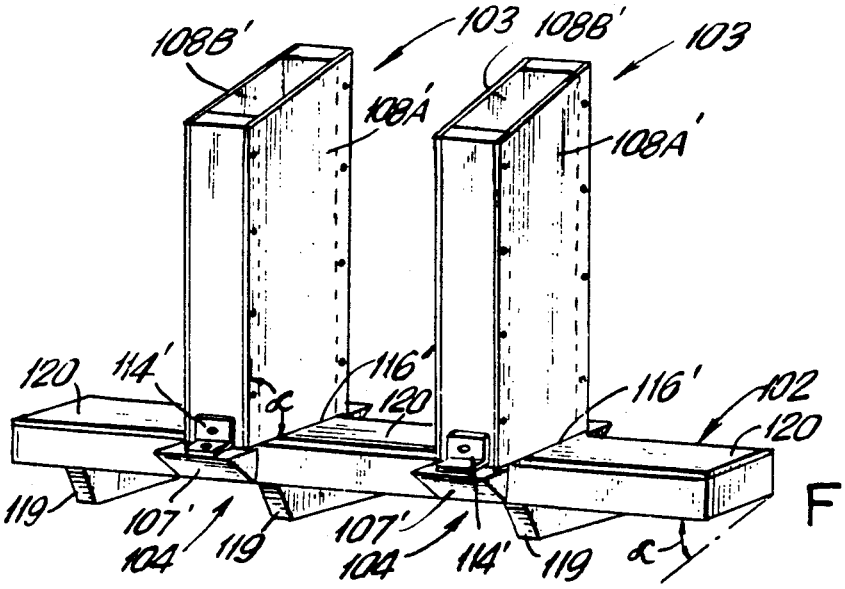
FIG. 24 is a perspective view of apparatus for molding another variety of retaining wall construction elements in accordance with the present invention.

Referring now to FIGS. 22, 23 and 24, apparatus for molding the construction elements of the present invention, will now be described below.

Preferably, all of the retaining wall construction elements of the present invention are formed from concrete, and to form the various construction elements described herein, the molding apparatus of the present invention can advantageously be employed.

In general, each particular embodiment of molding apparatus shown in FIGS. 22 and 24, comprises three principal components, namely: a face panel "mold portion" (i.e. form) 102; a protruding arm mold portion 103 for molding each of the protruding arms of the preferred embodiments; and support means 104. The function of the support means 104 is to support each of the protruding arm mold portions 103 substantially vertically upright while the face panel mold portion 102 is cooperatively positioned with respect to vertically upright protruding arm mold portions 103. With this arrangement, concrete can be poured into the protruding arm mold portions to fill up the face panel mold portion 102 up to a predetermined level; thereafter, the protruding arm mold portions can be filled up with poured concrete.

FIG. 23 illustrates structural components used to assemble the molding apparatus shown in FIG. 22. Notably, the apparatus of FIG. 23, with slight modifications, can be employed to mold the retaining wall construction elements illustrated in FIGS. 1, 3A, 3B, 5A, 5B, 6A, 6B, 11 and 18; whereas, the apparatus of FIG. 24 can be used to mold the retaining wall construction elements illustrated in FIGS. 9A and 9B.

As shown in FIG. 23, the face panel mold portion 102 comprises a rectangular vessel 105 whose internal surface dimensions are that of the face panel of a particular construction element to be molded. For purposes of illustration only, the face panel mold portions of FIGS. 22 and 23 are that of a reduced height face panel as illustrated, for example, in FIGS. 3A, 3B, 5A, 5B, 6A, 6B and 18. However, it could also take on internal molding dimensions for the face panel of the construction element of FIG. 1.

Projecting off the side wall panel 106 of the face panel mold portion 102 are two sets of opposing platforms 107. These platforms straddle mold portion 102 and are spaced apart at a distance generally equal to the distance between the protruding arms of the to-be-molded construction element. Each protruding arm mold portion 103 comprises a pair of rectangular side panels 108A and 108B, and a pair of mold ends 109A and 109B, each having a surface 110 which bears the "negative" surface pattern of the sawtooth notched pattern 15 used to realize the "engaging means" of the preferred embodiments. The dimensions of each side panel 108A and 108B are slightly greater than the side walls of the protruding arms, since each end portion 111 of the side panels overlap the mold ends as shown. This is to allow fastening devices such as bolts to pass through preformed holes 113 in the panels and preformed holes 112 in each mold end, to hold these components together during molding, and thus form vertical disposed mold cavities corresponding to the protruding arms to be formed. The assembled protruding arm mold portions 103 are each securely held in the vertical upright position by a pair of mounting brackets 114 connected to the lower outer portion of each mold end 109A, 109B and platforms 107 using hardware, as illustrated in FIGS. 22 and 23. Taken together, the platforms 107, mounting brackets 114 and hardware constitute the support means 104 described hereinabove in functional terms.

Once assembled, concrete is poured into the vertically-upright protruding mold portions 103 using longitudinal funnel-like structures 115, shown in FIG. 22 disposed slightly above and away from the mold portions 103. Poured concrete flows through the mold portions 103, fills up the face panel mold portion 102 up to a predetermined level line generally indicated by 116 in FIG. 22, and only thereafter the mold portions 103 begin to fill up with poured concrete. If a construction element of the type shown in FIGS. 6A and 6B is desired, the concrete should stop at the level line generally indicated at 117. If the construction element shown in FIG. 5A and 5B is desired, concrete is poured until the funnel structures 115 are completely filled up. Once the concrete sets, the funnel structures can be disassembled into their respective halves 115A and 115B by removal of bolts 118, and the molding apparatus disassembled as well, revealing a completely molded retaining wall construction element. Notably, a rectangular funnel structure can also be used in order to form the soiling anchoring means 23 of construction element 20, illustrated in FIGS. 3A and 3B.

In FIG. 24, apparatus is shown for molding construction elements, in which the face panel is disposed at an obtuse angle $\alpha$, discussed in great detail hereinabove. The apparatus of FIG. 24 is similar to the apparatus shown in FIG. 22, but for the following modifications. In order that the face panel is molded at predetermined angle $\alpha$, the face panel mold portion 102 is operatively supported at angle $\alpha$ with respect to vertically-supported protruding arm mold portions 103. As illustrated in FIG. 24, this support function can be achieved using a suitably adapted support means 104 comprising platforms 107', angulated mounting brackets 114', and wedge-like support members 119 positioned below the face panel mold portion 102.

In this embodiment, side panels 108A' and 108B' extend at an angle generally equal to $\alpha$, and define at line 116' where the molded protruding arms extend from the molded face panel. Also, in applications where angle $\alpha$ is steep, it may be necessary or desired to place mold covers 120 over the receptacle portion of mold 102, to retain cement that has been poured therein.

While particular embodiments shown and described above have been proven to be useful in many applications in the retaining wall art, further modifications of the present invention herein disclosed will occur to persons skilled in the art to which the present invention pertains and all such modifications are deemed to be within the scope and spirit of the present invention defined by the appended claims.

What is claimed is:

1. A construction element for retaining a soil mass, comprising:

a face panel being solid and having a forward wall, a rearward wall, side walls, a top wall and a bottom wall;

multiple protruding arms attached to said rearward wall of said face panel, said protruding arms being solid and having a rearward wall, an upper wall, a lower wall, a back wall and side walls; and alternating projections and indents disposed on said upper and lower walls of each said protruding arm, for facilitating stacking of at least a portion of said protruding arm of one said construction element on top of at least a portion of said protruding arm of another said construction element and for preventing relative sliding movement therebetween.

2. The construction of element of claim 1, wherein said alternating projections and indents comprises:

a first set of periodically alternating projections and indents provided to each said upper wall, and a second set of periodically alternating projections and indents provided to each said lower wall, wherein a selected portion of said first set of periodically alternating projections and indents of one said construction element is interengagable with a selected portion of said second set of periodically alternating projections and indents of another said construction element.

3. The construction element of claim 2, wherein said first and second sets of periodically alternating projections and indents each comprise a saw-tooth notched pattern formed in said upper and lower walls, respectively.

4. The construction element of claim 1, wherein said side walls of said protruding arms have a height that exceeds the height of said face panel.

5. The construction element of claim 1, wherein said protruding arms have multiple passageways for passage of soil.

6. The construction element of claim 1, wherein said face panel is disposed a non-perpendicularly at an angle with respect to said upper wall of said protruding arms.

7. The construction element of claim 1, wherein each said protruding arm integrally attached to said rearward wall of said face panel, and each said protruding arm further comprises a stem portion attached to said back wall of protruding arm.

8. The construction element as claimed in claim 7, wherein each said protruding arm is provided with a passageway for insertion of a tie-back rod for extension into said soil mass or land formation.

9. The construction element of claim 8, wherein each said passageway extends from said front wall to said back wall of said protruding arm.

10. The construction element of claim 1, wherein said side walls of said arms have the same height as said face panel.

11. The construction element of claim 1, wherein each said protruding arm further includes soil anchoring means integrally formed with at least a portion of said back wall and being capable of creating resistance to movement of said arm when surrounded by fill soil mass.

12. The construction element of claim 11, wherein said soil anchoring means comprises a V-shaped flared structure integrally formed, with at least a portion of said back wall of each said protruding arm.

13. The construction element of claim 11, wherein said anchoring means comprises a stem structure extending orthogenally from said side wall so that at least a portion of such said protruding arm has a T-shaped cross-sectional geometry.

14. A construction element for retaining a soil mass, comprising:

a face panel being solid and having a forward wall, a rearward wall, side walls and a top and bottom wall; and multiple protruding arms attached to said rearward wall of said face panel, said protruding arms being solid and having an upper wall, a lower wall, a back wall and side walls, said side walls of said protruding arm having a height that exceeds the height of said face panel; and alternating projections and indents disposed on said upper and lower walls of each said protruding arm, for facilitating stacking of at least a portion of said protruding arm of one said construction element on top of at least a portion of said protruding arm of another said construction element and for preventing relative sliding movement therebetween.

15. The construction element of claim 14, wherein said protruding arms have multiple passageways for passage of soil.

16. The construction element of claim 14, wherein each said protruding arm is integrally attached to said rearward wall of said face panel, and each said protruding arm further comprises a stem portion attached to said back wall of said protruding arm.

17. The construction element of claim 14, wherein said face panel is disposed at an angle with respect to said upper wall of said protruding arms.

18. The construction element as claimed in claim 14, wherein each said protruding arm is provided with a passageway for insertion of a tie back for extension into said soil mass or land formation.

19. The construction element of claim 18, wherein each said passageway extends from said front wall to said back wall of said protruding arm.

20. A retaining wall and soil reinforcement subsystem, which comprises:

one or more retaining wall construction elements capable of being stacked together to form a free-standing retaining wall structure, each said retaining wall construction element including (i) a face panel having a front wall, a rear wall, side walls, and top and bottom walls and (ii) multiple protruding arms, each protruding arm being attached to said rear wall and having an upper wall, a lower wall, a back wall and side walls, said face panel and multiple arms forming at least one open sided cavity for receipt of compactable soil mass behind said face panel, and (iii) alternating projections and indents disposed on said upper and lower walls of each protruding arm of said retaining wall construction element so as to permit said retaining wall construction element so as to permit said retaining wall construction elements to be arranged into at least one of a plurality of possible stacking configurations while preventing relative movement between said retaining wall construction elements; and one or more rigid structures positionable behind said face panel of each said retaining wall construction element and being extendable between layers of compactable soil mass disposed beyond said face panel and interlockable with said soil mass when said soil mass is compacted so as to create a substantially stable reinforced soil mass behind said face panel.

21. The retaining wall and soil reinforcement subsystem of claim 20, wherein said alternating projections and indents on said upper and lower walls comprises:

a first set of periodically alternating projections and indents provided to said upper wall, and a second set of periodically alternating projections and indents provided to said lower wall, and wherein a selected portion of said second set of periodically alternating projections and indents of one said retaining wall construction element is stackable upon and engagable with a selected portion of aid first set of periodically altnerating projections and indents of another said retaining wall construction element.

22. The retaining wall and soil reinforcement subsystem of claim 21, wherein said first set of periodically altnerating projections and indents comprises a first saw-tooth notched pattern provided to said upper wall, wherein said second set of periodically alternating projections and indents comprises a second saw-tooth notched pattern provided to said lower wall, and wherein a selected portion of said first saw-tooth notched pattern of one said retaining wall construction element is engagable with a selected portion of said saw-tooth notched pattern of another said retaining wall construction element.

23. The retaining wall and soil reinforcement subsystem of claim 22, wherein said side walls of said protruding arms have a height that exceeds the height of respective face panels.

24. The retaining wall and soil reinforcement subsystem of claim 23, wherein said retaining wall construction elements are arranged such that said face panels of at least two contiguous construction elements are disposed in substantially the same plane and wherebetween a longitudinal recess of predetermined dimensions is formed between the top and bottom walls of the face panels of said contiguous construction elements.

25. The retaining wall and soil reinforcement subsystem of claim 24, wherein a face panel insert of said predetermined dimensions is mounted within said longitudinal recess.

26. The retaining wall and soil reinforcement subsystem of claim 25, wherein said face panel insert is formed from a material selected from the group, consisting of treated timber and galvanized metal.

27. The retaining wall and soil reinforcement subsystem of claim 26, wherein said face panels are formed from concrete and said face panel is formed in the shape of a highway safety guard.

28. The retaining wall and said reinforcement system of claim 20, wherein said retaining wall construction elements are configured according to a brick-bonded stacking arrangement.

29. The retaining wall and soil reinforcement system of claim 20, wherein said retaining wall construction elements are configured according to a stack-bonded arrangement.

30. The retaining wall and soil reinforcement system of claim 20, wherein said retaining wall construction elements are configured according to stepped arrangement.

* * * * *